US007466952B2

(12) United States Patent
Ito et al.

(10) Patent No.: US 7,466,952 B2
(45) Date of Patent: Dec. 16, 2008

(54) IMAGE-FORMING MACHINE FIXING DEVICE WITH A NIPPING REGION HAVING A PRESSURE DISTRIBUTION

(75) Inventors: Hiroshi Ito, Osaka (JP); Haruo Koyama, Osaka (JP); Takao Besshi, Osaka (JP); Nobuyuki Kashiwagi, Osaka (JP); Junko Ito, Osaka (JP); Tadashi Ohba, Osaka (JP); Toshimitsu Takeuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 257 days.

(21) Appl. No.: 11/252,557

(22) Filed: Oct. 19, 2005

(65) Prior Publication Data

US 2007/0025784 A1 Feb. 1, 2007

(30) Foreign Application Priority Data

Jul. 29, 2005 (JP) ..... 2005-220762

(51) Int. Cl.
*G03G 15/20* (2006.01)

(52) U.S. Cl. ..... 399/329

(58) Field of Classification Search ..... 399/329; 219/216

See application file for complete search history.

(56) References Cited

U.S. PATENT DOCUMENTS 6,823,167 B1 * 11/2004 Gross et al. ..... 399/400
2004/0037597 A1 * 2/2004 Haseba et al. ..... 399/328
2004/0126157 A1 * 7/2004 Coleman et al. ..... 399/323
2004/0146323 A1 * 7/2004 Fujisawa et al. ..... 399/323
2005/0220506 A1 * 10/2005 Nakayama ..... 399/323

FOREIGN PATENT DOCUMENTS

| | | | |
|---|---|---|---|
| CN | 1490829 | | 4/2004 |
| JP | 2004037764 A | * | 2/2004 |
| JP | 2004-212844 | | 7/2004 |
| JP | 2005257968 A | * | 9/2005 |

OTHER PUBLICATIONS

Computer Translation of document JP2004-212844A to Maekawa et al., cited by Applicant.*

* cited by examiner

*Primary Examiner*—Quana Grainger
(74) *Attorney, Agent, or Firm*—Smith, Gambrell & Russell, LLP

(57) ABSTRACT

A fixing device comprises a thermally fixing roller, a belt, and pushing means which pushes the belt toward the thermally fixing roller. A nipping region is formed between the belt and the thermally fixing roller. A maximum pressure is produced in an upstream end region of the thermally fixing roller in the direction of rotation in the nipping region, another maximum pressure is produced in a downstream end region thereof in the direction of rotation in the nipping region, and a pressure is produced in an intermediate region, which pressure being not higher than the maximum pressure in the upstream end region and not higher than the another maximum pressure in the downstream end region.

9 Claims, 16 Drawing Sheets

Fig. 15

| NIPPING TIME S (sec) | FIXING | PARTING | CURL |
|---|---|---|---|
| 0.020 | × | × | ○ |
| 0.030 | × | × | ○ |
| 0.035 | × | × | ○ |
| 0.040 | ○ | ○ | ○ |
| 0.050 | ○ | ○ | ○ |
| 0.060 | ○ | ○ | ○ |
| 0.070 | ○ | ○ | ○ |
| 0.080 | ○ | ○ | ○ |
| 0.085 | × | × | ○ |
| 0.090 | × | × | △ |
| 0.100 | × | × | × |

Fig. 16

| GAP C BETWEEN THE PARTING MEMBER AND THERMALLY FIXING ROLLER (mm) | PARTING | SCARS ON THE THERMALLY FIXING ROLLER | CONTAMINATION ON THE PAPER SURFACE |
|---|---|---|---|
| 0 | ○ | × | × |
| 0.3 | ○ | × | × |
| 0.5 | ○ | ○ | ○ |
| 1.0 | ○ | ○ | ○ |
| 1.5 | ○ | ○ | ○ |
| 2.0 | ○ | ○ | ○ |
| 2.5 | × | ○ | ○ |

Fig. 17

| ANGLE ( θ ) OF INCLINATION OF THE PARTING MEMBER (deg) | PARTING | DISTURBANCE OF THE IMAGE |
|---|---|---|
| 0 | ○ | ○ |
| 5 | ○ | ○ |
| 10 | ○ | ○ |
| 15 | ○ | ○ |
| 20 | ○ | ○ |
| 25 | ○ | ○ |
| 30 | ○ | ○ |
| 35 | ○ | ○ |
| 40 | ○ | ○ |
| 45 | × | × |
| 50 | × | × |

Fig. 18

| PARTING TIME T (sec)/ NIPPING TIMES S (sec) (%) | PARTING | CURL |
|---|---|---|
| 50 | × | ○ |
| 60 | ○ | ○ |
| 70 | ○ | ○ |
| 80 | ○ | ○ |
| 90 | ○ | ○ |
| 100 | ○ | ○ |
| 110 | ○ | × |
| 120 | ○ | × |

IMAGE-FORMING MACHINE FIXING DEVICE WITH A NIPPING REGION HAVING A PRESSURE DISTRIBUTION

BACKGROUND OF THE INVENTION

1. Field of the invention

The present invention relates to a fixing device mounted on image-forming machines such as a copier of the type of electrostatic photography, a printer and a facsimile. More specifically, the invention relates to a fixing device which includes a thermally fixing roller, an endless belt, and pushing means which pushes the belt toward the thermally fixing roller from the side of the inner peripheral surface of the belt such that part of the region in the circumferential direction on the outer peripheral surface of the belt is pushed onto part of the region in the circumferential direction on the outer peripheral surface of the thermally fixing roller, wherein the belt is driven when the thermally fixing roller is driven to rotate.

2. Description of the Related Art

As a fixing device mounted on an image-forming machine, there has heretofore been widely used the one of a form including a thermally fixing roller that is heated by a source of heat and a pressing roller that is brought into pressed contact with the thermally fixing roller. In a fixing device for a color image-forming machine that is finding a widening application in recent years, however, toners of, for example, four colors must be fixed in an overlapped manner and, hence, fixing property must be improved as compared to that of the fixing device used for the monochromatic image-forming machines. One of the means for improving the fixing property may be to increase the thickness of the elastic layer provided on the thermally fixing roller and/or on the pressing roller, such as increasing the thickness of the elastic layer of the pressing roller or forming an elastic layer on the surface of the thermally fixing roller, in order to increase a nipping width between the thermally fixing roller and the pressing roller.

However, it is a new trend to decrease the thickness of the elastic layer of the thermally fixing roller as much as possible to meet the countermeasure for saving energy on a global scale in recent years as well as to meet the user's requirements for shortening the warming-up time of the fixing device and saving the consumption of electric power. If the thickness of the elastic layer of the thermally fixing roller is decreased as much as possible, however, the nipping width decreases between the thermally fixing roller and the pressing roller, and the fixing property is spoiled.

In view of the above technical background, there has been developed a fixing device equipped with an endless belt mechanism instead of the pressing roller. A representative example of the fixing device of this kind may be the one which comprises a thermally fixing roller, an endless belt, and pushing means which pushes the belt toward the thermally fixing roller from the side of the inner peripheral surface of the belt such that part of the region in the circumferential direction on the outer peripheral surface of the belt is pushed onto part of the region in the circumferential direction on the outer peripheral surface of the thermally fixing roller, wherein a nipping region is formed between part of the region of the belt and part of the region of the thermally fixing roller that come in contact with each other, and the belt is driven when the thermally fixing roller is driven to rotate. The pushing means includes an upstream support roller arranged on the upstream side of the thermally fixing roller in the direction of rotation, a downstream support roller arranged on the downstream side in the direction of rotation, and a spring mechanism for pushing the upstream support roller and the downstream support roller onto the thermally fixing roller via the belt (see JP-A-2004-212844).

According to the above belt-type fixing device, the nipping width between the belt and the thermally fixing roller can be increased yet decreasing the thickness of the elastic layer of the thermally fixing roller as much a possible, and good fixing property can be accomplished. Though the above advantage is obtained, however, a too increased nipping width of the belt relative to the thermally fixing roller causes the paper to move along the curvature of the thermally fixing roller for an extended period of time and, hence, to be excessively heated developing such inconvenience that the water content contained in the paper is excessively evaporated forming a defective image (white spots), the paper is poorly parted from the thermally fixing roller, the paper is curled, etc. The paper can be effectively parted by arranging peeling pawls and by brining the peeling pawls into contact with the thermally fixing roller. When the above countermeasure is put into effect, however, wear increases on the surface of the thermally fixing roller, scars occur, life of the fixing device is shortened, and it is forced to replace the fixing device at the time of maintenance of the image-forming machine. Besides, the toner and the paper dust stay between the thermally fixing roller and the peeling pawls to contaminate the surfaces of the paper.

SUMMARY OF THE INVENTION

It is an object of the present invention to provide a novel fixing device which makes it possible to maintain good fixing property preventing the formation of defective image (white spots).

Another object of the present invention is to provide a novel fixing device which improves the parting performance of the paper from the thermally fixing roller yet maintaining good fixing property, and prevents the paper from being curled.

A further object of the present invention is to provide a novel fixing device which prevents the occurrence of scars on the outer peripheral surface of the thermally fixing roller, prevents the surface of the paper from being contaminated yet maintaining good fixing property, and improves the parting performance of the paper from the thermally fixing roller.

A still further object of the present invention is to provide a novel fixing device which improves the parting performance of the paper from the thermally fixing roller yet maintaining good fixing property, and prevents the occurrence of disturbance on the image and prevents the paper from being curled.

Through their keen study, the present inventors have discovered that the fixing property, parting performance of the paper and occurrence of curl are greatly affected by a distribution of pressures in the circumferential direction of the nipping region between the belt and the thermally fixing roller, by a nipping time from when the upstream end of part of the region of the belt separates away from the thermally fixing roller after having moved accompanying the turn of the thermally fixing roller, by a relationship between the constitution of the parting member and the thermally fixing roller, and by a relationship between the nipping time and a parting time that will be described later, and have invented means for solving the problems.

According to the present invention, there is provided a fixing device comprising a thermally fixing roller, an endless belt, and pushing means which pushes the belt toward the thermally fixing roller from the side of the inner peripheral surface of the belt such that part of the region in the circumferential direction on the outer peripheral surface of the belt is pushed onto part of the region in the circumferential direction on the outer peripheral surface of the thermally fixing roller, wherein a nipping region is formed between part of the region of the belt and part of the region of the thermally fixing roller that come in contact with each other, and the belt is driven when the thermally fixing roller is driven to rotate, and wherein part of the region of the belt is pushed by pushing means onto part of the region of the thermally fixing roller in a manner that a pressure distribution is established in the circumferential direction of the nipping region producing a maximum pressure in an upstream end region of the thermally fixing roller in the direction of rotation in the nipping region, another maximum pressure in a downstream end region thereof in the direction of rotation in the nipping region, and a pressure in an intermediate region of the nipping region between the upstream end region and the downstream end region, which pressure being not higher than the maximum pressure in the upstream end region and not higher than the another maximum pressure in the downstream end region.

It is desired that the thermally fixing roller includes a cylindrical main body made of a metal and an elastic layer arranged on the outer peripheral surface of the cylindrical main body, a pushing portion in the downstream end region of the pushing means is constituted by a member harder than the elastic layer, and the maximum pressure in the upstream end region in the nipping region is smaller than the another maximum pressure in the downstream end region.

It is desired that when the diameter of the thermally fixing roller is denoted by D (mm), the length of the nipping region in the circumferential direction by L (mm), the rotational speed of the thermally fixing roller by R (rpm), and when the nipping time S (seconds) until when the upstream end of part of the region of the belt separates away from the thermally fixing roller after having moved accompanying the turn of the thermally fixing roller is denoted by 60 L/RπD, the nipping time S (seconds) is defined to satisfy the following formula, $$0.04(\text{seconds}) \leqq S(\text{seconds}) \leqq 0.08(\text{seconds}).$$

It is desired that provision is made of a parting member for parting the paper conveyed through the nipping region from the outer peripheral surface of the thermally fixing roller, the parting member being made of a piece of metal plate extending in the axial direction of the thermally fixing roller, and having a parting portion linearly extending toward the outer peripheral surface of the thermally fixing roller from the outer side in the radial direction of the thermally fixing roller and toward the upstream from the downstream in the direction of rotation when the thermally fixing roller is viewed in the axial direction, and the tip of the parting portion is positioned maintaining a gap of 0.5 mm to 2.0 mm with respect to the outer peripheral surface on the paper-passing region of the thermally fixing roller.

It is desired that when the thermally fixing roller is viewed in the axial direction, the angle of inclination of the outer surface of the parting portion is not larger than 40 degrees, which is defined by a straight line in agreement with the outer surface of the parting portion and by a tangential line of the outer peripheral surface of the thermally fixing roller that passes through a point where the straight line in agreement with the outer surface of the parting portion intersects the outer peripheral surface on the paper-passing region of the thermally fixing roller.

It is desired that when the thermally fixing roller is viewed in the axial direction and when a time from when a point on the outer peripheral surface of the thermally fixing roller has separated away from the nipping region until when it arrives at a point where a straight line in agreement with the outer surface of the parting portion of the parting member intersects the outer peripheral surface on the paper-passing region of the thermally fixing roller, is regarded to be a parting time T (seconds), the parting time T (seconds) is defined to be within 60% to 100% of the nipping time S (seconds).

It is desired that positioning means equipped with a circular outer peripheral surface in concentric with the thermally fixing roller is arranged on each of the paper non-passing regions which are both end regions of the thermally fixing roller in the axial direction, and tips at both ends of the parting member in the axial direction come in contact with the outer peripheral surface of the corresponding positioning means to set the gap.

It is desired that each of the positioning means comprises a positioning portion arranged integrally on the thermally fixing roller and a bearing member for rotatably supporting the thermally fixing roller.

It is desired that a plurality of guide ribs are arranged on the parting member maintaining a distance in the axial direction, the guide ribs being so arranged as to extend toward the downstream in the direction of conveyance from the downstream end region of the paper in the direction of conveyance on the outer surface of the parting portion and to extend outward of the outer surface of the parting portion.

BRIEF DESCRIPTION OF THE DRAWINGS

FIG. 15 is a table showing the results of Experiment 2 conducted by the present inventors;

FIG. 16 is a table showing the results of Experiment 3 conducted by the present inventors;

FIG. 17 is a table showing the results of Experiment 4 conducted by the present inventors; and FIG. 18 is a table showing the results of Experiment 5 conducted by the present inventors.

DESCRIPTION OF THE PREFERRED EMBODIMENTS

Figure 1:
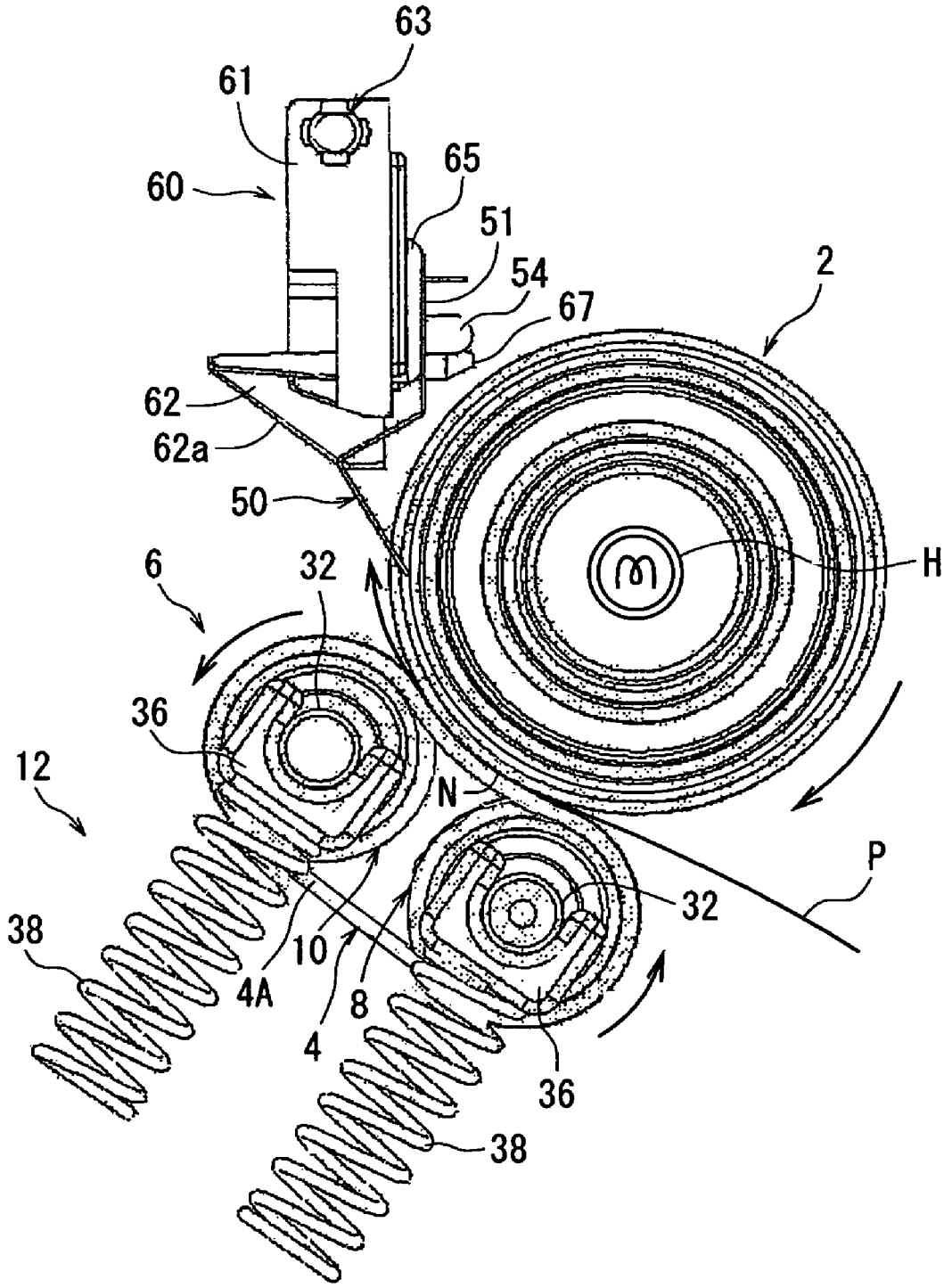
FIG. 1 is a view schematically illustrating the constitution of a major portion of an embodiment of a fixing device according to the present invention, and is a schematic view of the constitution as viewed in the axial direction of the rollers.

Preferred embodiments of a fixing device constituted according to the present invention will now be described in detail with reference to the accompanying drawings. In FIGS. 1 to 13, the portions which are substantially the same are denoted by the same reference numerals.

Referring to FIG. 1, the fixing device includes a thermally fixing roller 2, an endless belt 4, and pushing means 6 which pushes the belt 4 toward the thermally fixing roller 2 from the side of the inner peripheral surface of the belt 4 such that part of the region in the circumferential direction on the outer peripheral surface of the belt 4 is pushed onto part of the region in the circumferential direction on the outer peripheral surface of the thermally fixing roller 2. The thermally fixing roller 2 is drivingly coupled to an electric motor via a power transmission mechanism inclusive of gears (which are not shown), and is driven to rotate in the clockwise direction in FIG. 1. The pushing means 6 includes at least one pushing member or, in this embodiment, an upstream support roller 8 and a downstream support roller 10 arranged on the outer side in the radial direction of the thermally fixing roller 2 maintaining a distance from each other in the circumferential direction, and a pushing mechanism 12 for pushing the upstream support roller 8 and the downstream support roller 10 onto the thermally fixing roller 2 via the belt 4. The upstream support roller 8 is arranged on the upstream of the thermally fixing roller 2 in the direction of rotation, and the downstream support roller 10 is arranged on the downstream of the thermally fixing roller 2 in the direction of rotation. The belt 4 is wrapped round between the upstream support roller 8 and the downstream support roller 10. A nipping region N is formed between part of the region of the belt 4 and part of the region of the thermally fixing roller 2 that are brought into contact with each other. When the thermally fixing roller 2 is driven to rotate, the belt 4, upstream support roller 8 and downstream support roller 10 are also driven.

The downstream support roller 10 is pushed onto the thermally fixing roller 2 via the belt 4. Part of the region in the circumferential direction of the belt 4 or, in this embodiment, part of the region of the belt 4 upstream of the nipping portion between the downstream support roller 10 and the thermally fixing roller 2, produces a nipping action with part of the region of the thermally fixing roller 2. A region in the circumferential direction of the upstream support roller 8 round where the belt 4 is wrapped, that is facing the thermally fixing roller 2, is positioned maintaining a gap relative to the thermally fixing roller 2 in a state where the belt 4 is wrapped round. The paper P is conveyed through the nipping region N from the right toward the left in FIG. 1.

Figure 2:
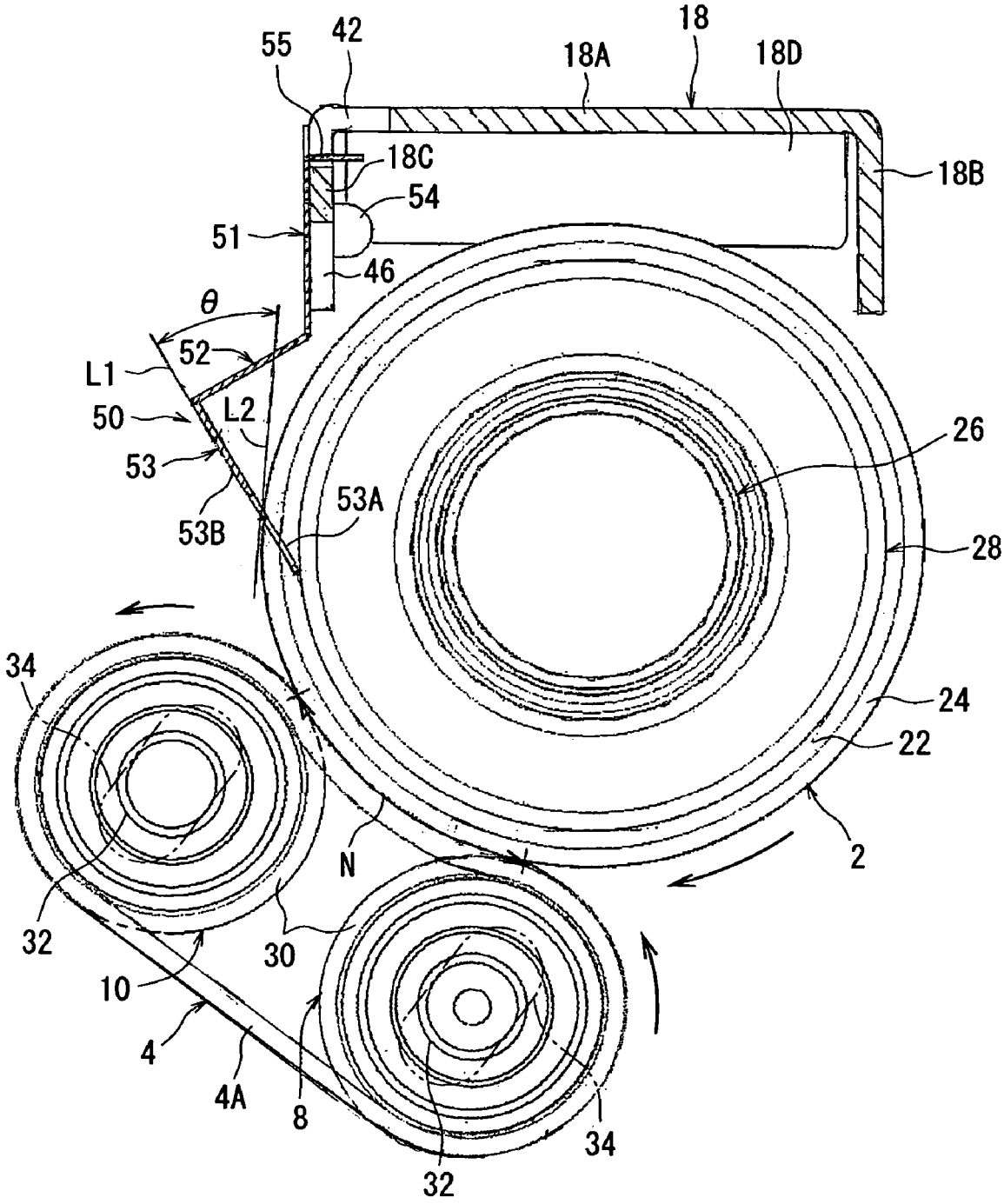
FIG. 2 is a view schematically illustrating the constitution of the fixing device shown in FIG. 1 omitting part of the constitution while adding other constitution, and is a schematic view of the constitution partly in cross section.
Figure 4:
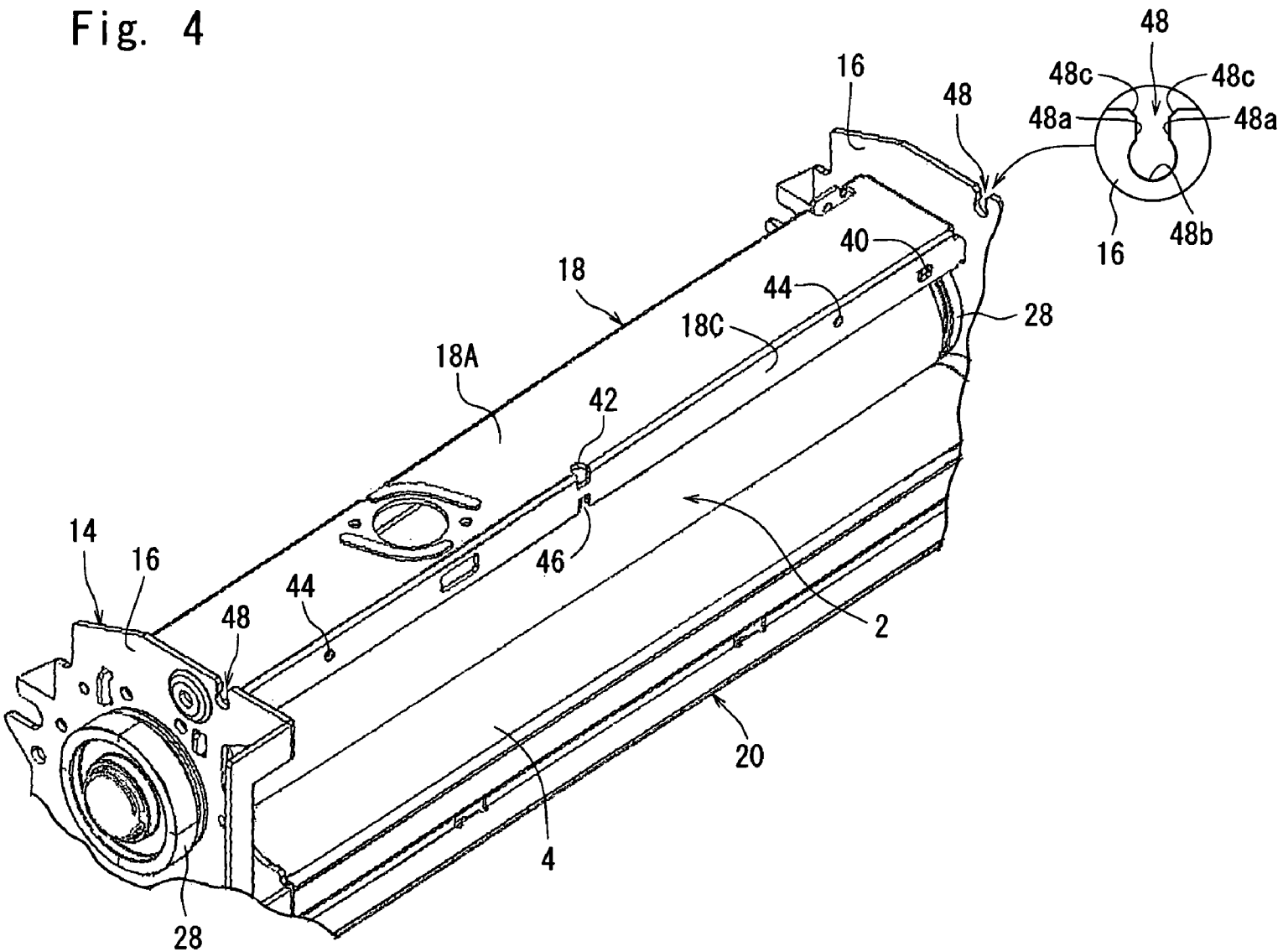
FIG. 4 is a perspective view of the fixing device shown in FIG. 2 omitting part of the constitution while adding other constitution.
Figure 5:
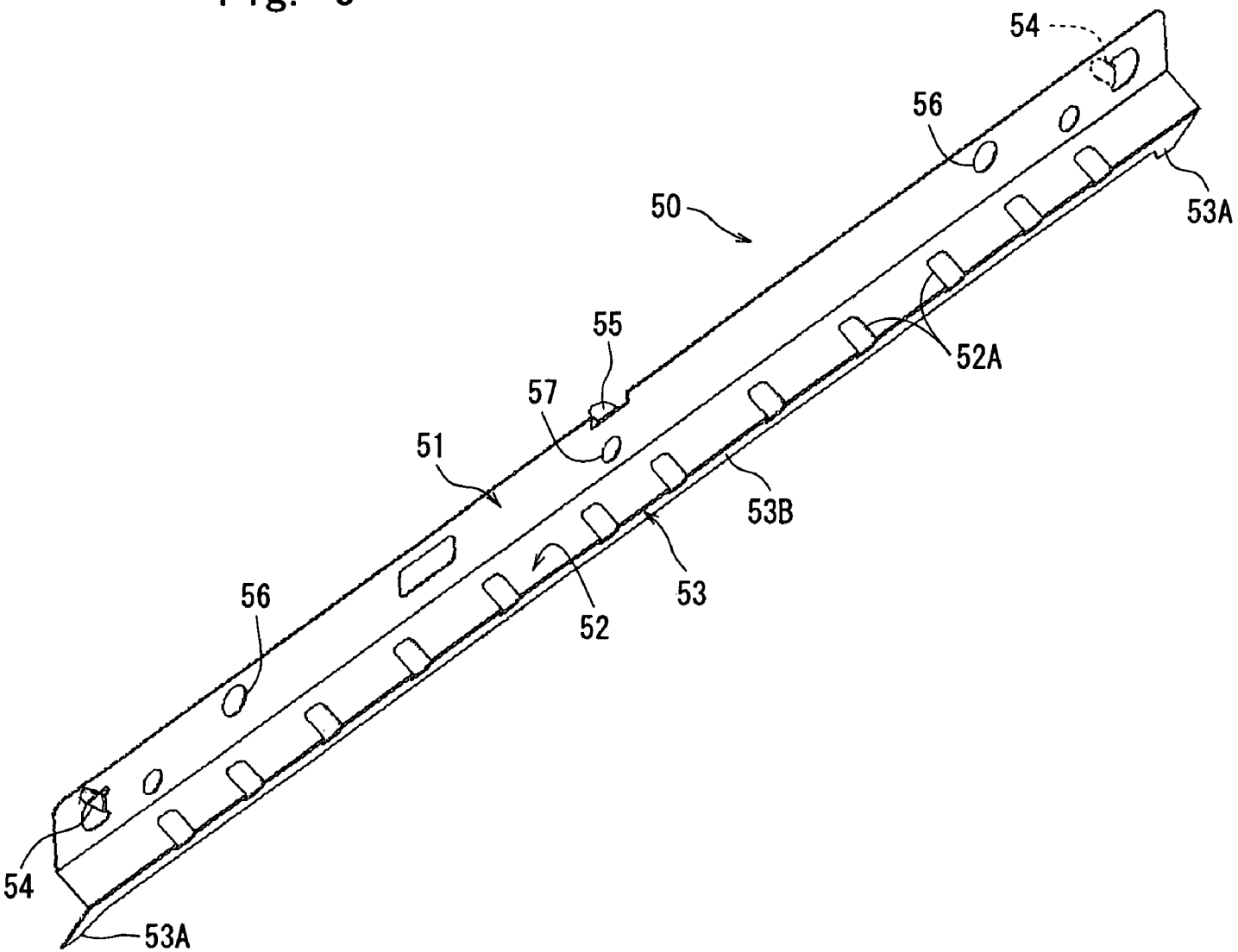
FIG. 5 is a perspective view of the parting member shown in FIG. 2.

Referring to FIGS. 1, 2 and 4, the fixing device has a metallic frame 14. The frame 14 includes a pair of side plates 16 made of metal plates, and coupling means for coupling the side plates 16 in a manner of facing each other in parallel maintaining a distance from each other. The coupling means includes an upper coupling plate member 18 for coupling the upper regions of the side plates 16 together, an upstream lower coupling plate member (not shown) for coupling the lower regions of the side plates 4, and a downstream lower coupling plate member 20. The upstream and downstream stands for the upstream side and the downstream side of the paper P in the direction of conveyance, which, in FIGS. 1 and 2, stand for a direction from the right. toward the left upper side and, which, in FIG. 4, stand for a direction roughly from the left toward the right.

The thermally fixing roller 2 includes a cylindrical main body 22 made of a metal such as aluminum, and an elastic layer 24 of a silicone rubber or the like arranged on the outer peripheral surface of the cylindrical main body 22. The thermally fixing roller 2 has a shaft 26 formed integrally therewith so as to extend beyond both sides of the cylindrical main body 22 in the axial direction. The shaft 26 is rotatably supported at the central regions of the corresponding side plates 16 via bearings 28. A halogen heater H which is a source of heat is arranged in the central portion of the thermally fixing roller 2. Both ends of the halogen heater H are supported in a stationary manner by the side covers (not shown) which are detachably attached to the outer sides of the side plates 16.

Referring to FIGS. 1 and 2, the upstream support roller 8 and the downstream support roller 10 having substantially the same constitution are each equipped with a cylindrical main body 30 made of a metal such as SUS. Cylindrical shafts 32 of a diameter smaller than the cylindrical main body 30 are formed at both ends of the cylindrical main body 30 integrally therewith so as to extend beyond both ends thereof in the axial direction. The shafts 32 of the upstream support roller 8 and of the downstream support roller 10 are supported by elongated holes 34 (represented by a two-dot chain line in FIG. 2) formed in the side plates 16 so as to rotate and to slide along the elongated holes 34. When the thermally fixing roller 2 is viewed in the axial direction, the elongated holes 34 are so formed as to extend along two imaginary lines (not shown) in parallel with an imaginary line (not shown) that passes through the axis of the thermally fixing roller 2.

Shafts 32 of the upstream support roller 8 and of the downstream support roller 10 are rotatably supported by bearing members 36 having semicircular bearing portions, and compression coil springs 38 are arranged between the bearing members 36 and the corresponding side plates 16. The compression coil springs 38 are pushing the corresponding bearing members 36 toward the thermally fixing roller 2. When the thermally fixing roller 2 is viewed in the axial direction, the pushing direction of the compression coil springs 38 is the one headed to the thermally fixing roller 2 along the above two imaginary lines in parallel with the above imaginary line that passes through the axis of the thermally fixing roller 2. Parts of the regions in the circumferential direction of the outer peripheral surfaces of the upstream support roller 8 and of the downstream support roller 10 are pushed onto parts of the regions in the circumferential direction of the outer peripheral surface of the thermally fixing roller 2 via the belt 4. Part of the region in the circumferential direction of the outer peripheral surface of the belt 4 is pushed onto part of the region in the circumferential direction of the outer peripheral surface of the thermally fixing roller 2. Upon suitably setting a distance between the elongated holes 34 or upon suitably setting a direction in which the elongated holes 34 extend, a desired tension is imparted to the belt 4. The pushing mechanism 12 is constituted by the elongated holes 34, bearing members 36 and compression coil springs 38. The belt 4 is made of a polyimide resin. Ribs 4A for preventing meandering are formed extending, along the whole circumference on the inner peripheral surface at both ends of the belt 4 in the direction of width (both ends in a direction perpendicular to the surface of the paper in FIGS. 1 and 2). The inner surfaces of the ribs 4A of the belt 4 in the direction of width are positioned on the outer sides of both ends in the axial direction of the cylindrical main bodies 30 of the upstream support roller 8 and of the downstream support roller 10.

Referring to FIGS. 2 and 4, the upper coupling plate member 18 of the frame 14 includes a top plate 18a which extends straight in the axial direction of the thermally fixing roller 2 maintaining a predetermined width (width in the right-and-left direction in FIG. 2), a pair of side plates 18B and 18C hanging from both sides of the top plate 18A, and a pair of end plates 18D (FIG. 2 shows only one of them) hanging from both ends in the axial direction of the top plate 18A. The upper coupling plate member 18 has the end plates 18D that are positioned facing the inner side surfaces of the corresponding side plates 16, and is fastened by fastening members that are not shown to couple the upper ends of the side plates 16. The top plate 18A of the upper coupling plate member 18 extends over the thermally fixing roller 2 in parallel with the axis of the thermally fixing roller 2.

In the upper coupling plate member 18, engaging holes 40 (FIG. 4 shows only one of them) elongated in the lengthwise direction are formed at both ends in the lengthwise direction (direction in which the side plates 16 are facing each other) of the side plate 18C positioned on the downstream side. The elongated engaging holes 40 having substantially the same constitution (in other words, having substantially the same shape and size) are extending in the lengthwise direction maintaining a predetermined width in the up-and-down direction. An engaging hole 42 is formed in a corner portion where the side plate 18C intersects the top plate 18A, the corner portion being located at the center in the lengthwise direction. The engaging hole 42 is formed extending across the side plate 18C and the top plate 18A and maintaining a predetermined width in the lengthwise direction. Internally threaded holes 44 are formed in the side plate 18C at positions on the inside of the elongated engaging holes 40 in the lengthwise direction. An engaging groove 46 is formed at a lower end of the side plate 18C under an engaging hole 42. The engaging groove 46 extends upward from the lower end maintaining a predetermined width in the length wise direction, and is assuming a rectangular shape that is opened downward as viewed in the direction of conveyance. The upstream lower coupling member that is not shown and the downstream lower coupling member 20 have constitutions that are not directly related to the present invention, and are not described here.

Engaging grooves 48 that are opening are formed at the upper ends of the corresponding side plates 16 at positions slightly downstream of the side plate 18C of the upper coupling plate member 18. As clearly shown in FIG. 4, the engaging grooves 48 having substantially the same constitution are facing each other maintaining a distance in the direction of conveyance, and have a pair of opposing inner surfaces 48*a* extending straight and in parallel in the up-and-down direction, and an arcuate inner surface 48*b* larger than a semicircle. Upper ends of the opposing inner surface 48*a* are opened at the upper end of the side plate 16 via tilted surfaces 48*c*, and lower ends thereof are connected to both ends of the arcuate inner surface 48*b*. The tilted surfaces 48*c* are extending from the upper ends of the corresponding opposing inner surfaces 48*a* toward the upper end of the side plate 16 in the directions in which they separate away from each other.

The fixing device includes a parting member 50 and a cover 60. Referring to FIGS. 2 to 5, the parting member 50 for parting the paper from the thermally fixing roller 2 includes a support main body portion 51 made of a metal plate or, in this embodiment, a single SUS plate assuming a slender rectangular flat plate shape, an intermediate portion 52, and a parting portion 53. The support main body portion 51 extends straight maintaining a predetermined width in the up-and-down direction. The intermediate portion 52 is extending straight being inclined downward toward the downstream from the lower end of the support main body portion 51. The parting portion 53 is extending straight being inclined downward toward the upstream from the lower end of the intermediate portion 52. The width of the parting portion 53 in the inclined direction remains constant in the intermediate region 53B except the regions 53A at both ends. The regions 53A at both ends are extending straight from the lower ends of the intermediate region 53B being inclined downward by the same length. In the intermediate portion 52, there are formed a plurality of notches 52A maintaining a distance in the lengthwise direction. The notches 52A have substantially the same shape and the same size, i.e., have substantially a rectangular shape, and their ends are formed spanning across the upper end of the parting portion 53.

To-be-engaged tongue pieces 54 are formed at both ends in the lengthwise direction of the support main body portion 51 so as to extend at right angles with the upstream direction maintaining a predetermined width in the up-and-down direction. The to-be-engaged tongue pieces 54 are formed being corresponded to the elongated engaging holes 40 formed in the side plate 18C of the upper coupling plate member 18. A to-be-engaged tongue piece 55 is formed at the central portion in the lengthwise direction of the support main body portion 51 so as to extend at right angles with the upstream direction maintaining a predetermined width in the lengthwise direction. The to-be-engaged tongue piece 55 is formed being corresponded to the engaging hole 42 formed in the side plate 18C of the upper coupling plate member 18. Through holes 56 are formed in the support main body portion 51 at both ends closer to the center than the positions where the to-be-engaged tongue pieces 54 are formed in the lengthwise direction. The through holes 56 are formed being corresponded to the internally threaded holes 44 formed in the side plate 18C of the upper coupling plate member 18. A through hole 57 is formed in the support main body portion 51 under the position where the to-be-engaged tongue piece 55 is formed. The through hole 57 is formed being corresponded to the engaging groove 46 formed in the side plate 18C of the upper coupling plate member 18.

The thus constituted parting member 50 is false-mounted on the side plate 18C on the downstream of the upper coupling plate member 18 from the downstream side so as to be parted. That is, the to-be-engaged tongue pieces 54 formed at both ends of the parting member 50 are inserted in the corresponding elongated engaging holes 40 in a manner to be parted, and the to-be-engaged tongue piece 55 formed at the central portion of the support main body portion 51 is inserted in the corresponding engaging hole 42 in a manner to be parted. Therefore, the parting member 50 is false-mounted in a state where the support main body portion 51 is overlapped on the surface of the side plate 18C of the upper coupling plate member 18 which is facing in the downstream direction, unless it is pulled in the downstream direction from the side plate 18C of the upper coupling plate member 18. The sizes between the to-be-engaged tongue pieces 54 and the corresponding elongated engaging holes 40 in the up-and-down direction are so determined that the to-be-engaged tongue pieces 54 can be slightly moved in the up-and-down direction relative to the corresponding elongated engaging holes 40 in a state where the to-be-engaged tongue pieces 54 of the parting member 50 are inserted in the corresponding elongated engaging holes 40. The through holes 56 in the support main body portion 51 are positioned substantially in concentric with the corresponding internally threaded holes 44 of the side plate 18C. The diameters of the through holes 56 are greater than the diameters of the corresponding internally threaded holes 44. The tips of the regions 53A at both ends of the parting portion 53 of the parting member 50 are brought into contact with the outer peripheral surfaces of the corresponding bearings 28 of the thermally fixing roller 2. The intermediate region 53B in the parting portion 53 is positioned maintaining a gap relative to the outer peripheral surface of the thermally fixing roller 20.

Figure 6:
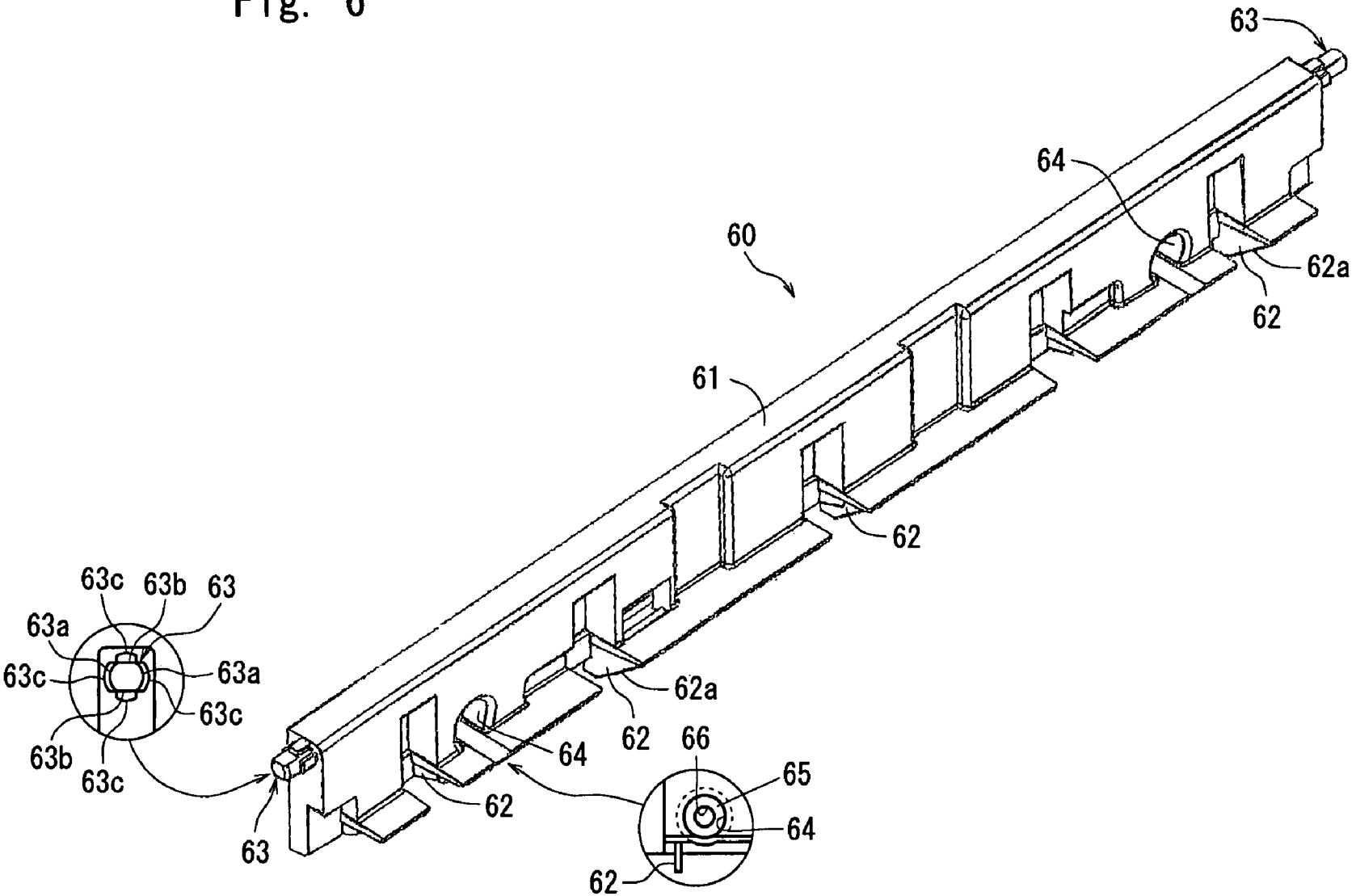
FIG. 6 is a perspective view of a cover shown in FIG. 1.
Figure 7:
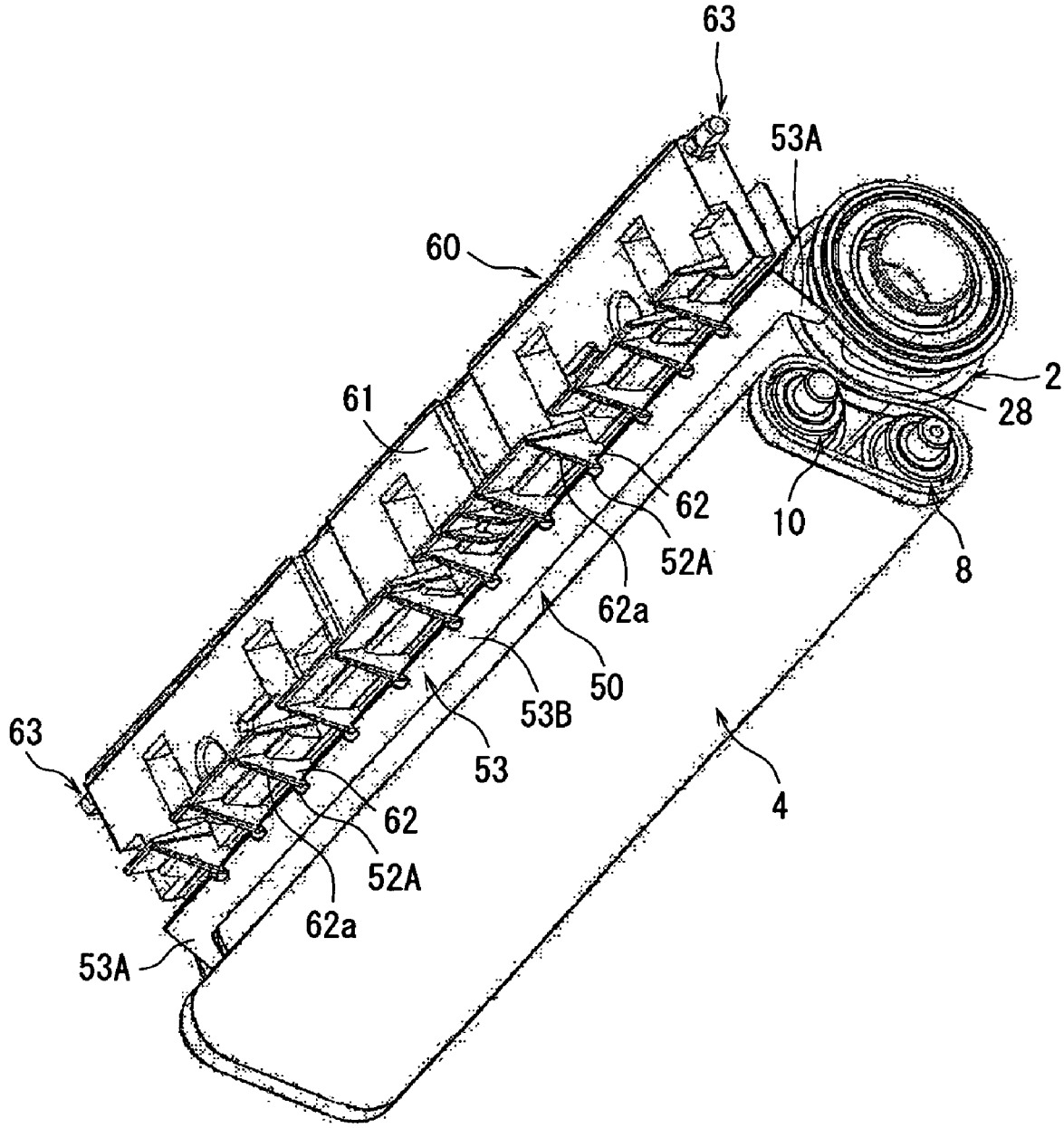
FIG. 7 is a perspective view schematically illustrating the fixing device shown in FIG. 1 as viewed from the lower direction while omitting part of the constitution.
Figure 8:
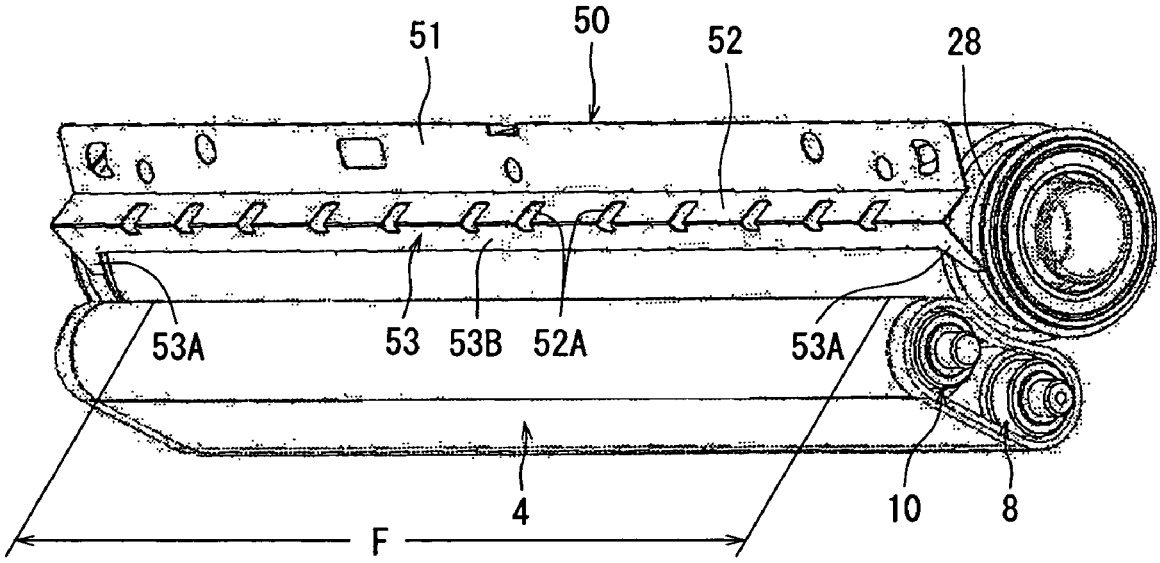
FIG. 8 is a perspective view schematically illustrating the fixing device shown in FIG. 7 as viewed from another lower direction while omitting the cover.
Figure 9:
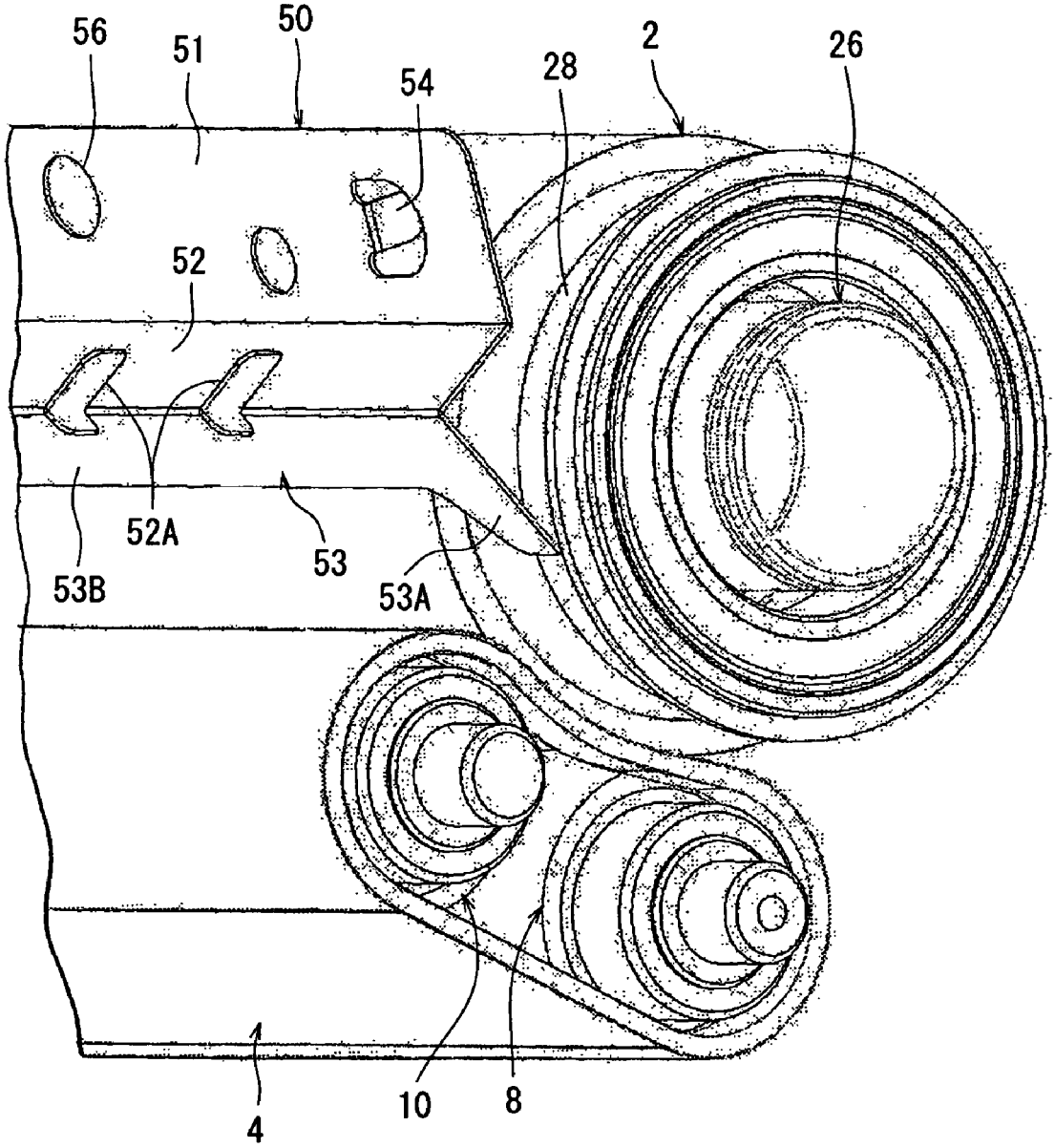
FIG. 9 is a perspective view schematically illustrating a portion of FIG. 8 on an enlarged scale, and is a schematic perspective view illustrating chiefly an embodiment of parting member positioning means.
Figure 10:
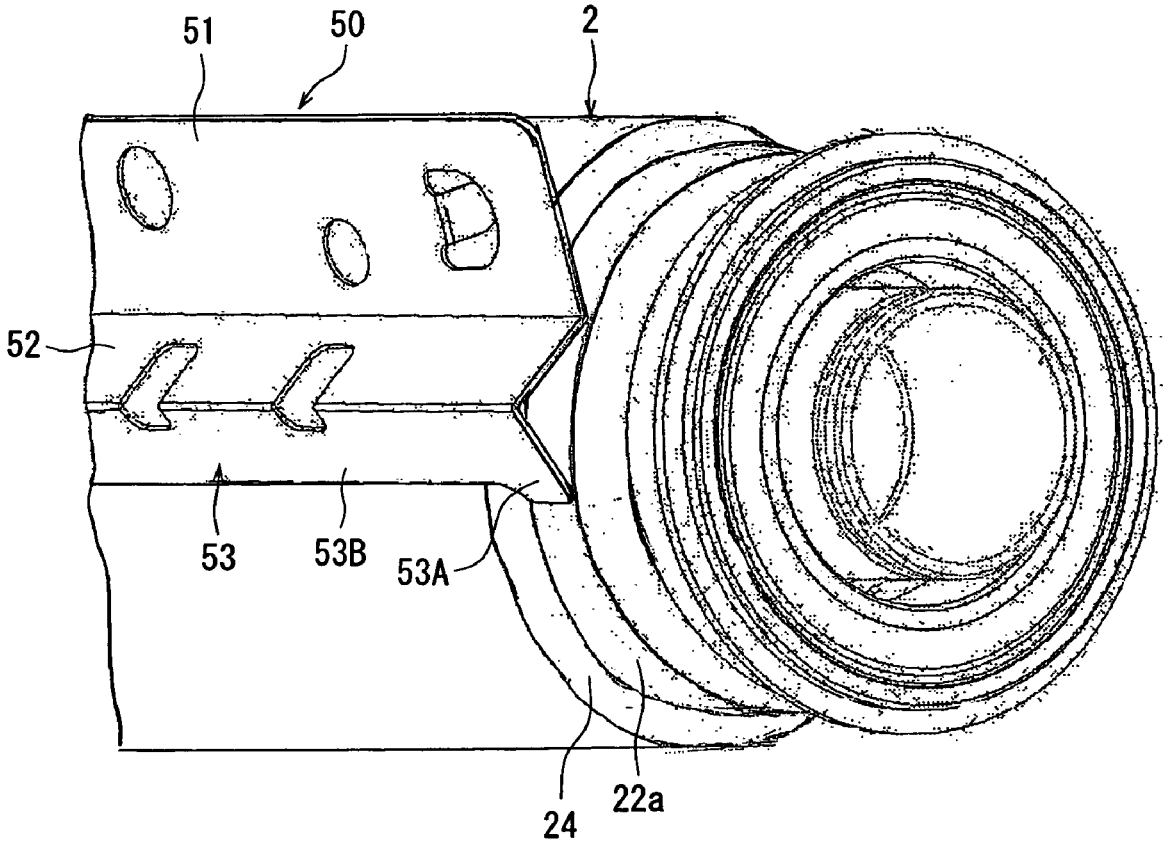
FIG. 10 is a schematic perspective view illustrating another embodiment of parting member positioning means, and is a schematic perspective view corresponding to FIG. 9.

Next, a cover 60 will be described. Referring to FIGS. 1, 6 and 7, the cover 60 that can be integrally molded by using a suitable synthetic resin includes a main body potion 61 which linearly extends maintaining a predetermined width in the up-and-down direction, and a plurality of guide ribs 62 arranged a the lower ends of the main body portion 61. The guide ribs 62 for the paper P are formed in a plural number maintaining a distance in the lengthwise direction of the main body portion 61, are supported by the side plates 16 in a manner as will be described later, and are forming lower guide surfaces 62*a* extending being inclined upward from the upstream toward the downstream in a state of being fastened to the side plate 18C on the downstream of the upper coupling plate member 18. To-be-supported pins 63 are formed at the upper both ends in the lengthwise direction of the main body portion 61 so as to extend outward in the lengthwise direction. In the regions at the ends in the axial direction of the to-be-supported pins 63 which are constituted in substantially the same manner and are arranged on a common axis, there are formed arcuate outer peripheral surfaces 63*a* at a pair of symmetrical positions with the axis sandwiched therebetween and in concentric with each other, and flat surfaces 63*b* formed at another pair of symmetrical positions with the axis sandwiched therebetween and extending in parallel with each other along the axis. In the proximal regions in the axial direction of the to-be-supported pins 63, further, there are formed four arcuate outer peripheral surfaces 63*c* at positions in the circumferential direction corresponding to the arcuate outer peripheral surfaces 63*a* and to the flat surfaces 63*b*. The arcuate outer peripheral surfaces 63*c* are in concentric with the arcuate outer peripheral surface 63*a*, and have the same radius of curvature which is greater than the radius of curvature of the arcuate outer peripheral surfaces 63*a*.

At both ends in the lengthwise direction of the main body portion 61, there are formed cylindrical bosses 64 extending in the upstream direction. Through holes 66 in concentric with the bosses 64 are formed at the central portions in the end wall 65 formed in the upstream ends of the bosses 64. The through holes 66 are formed being corresponded to the internally threaded holes 44 formed in the side plate 18C of the upper coupling plate member 18 (FIG. 4) and to the through holes 56 formed in the support main body portion 51 of the parting member 50 (FIG. 5), and have nearly the same diameter as the through holes 56. The surfaces on the upstream of the end walls 65 of the bosses 64 are existing on a substantially common vertical surface. A to-be-engaged pin 67 (FIG. 1) extending toward the upstream is formed at the central portion in the lengthwise direction of the main body portion 61 at the lower end thereof. The tip of the to-be-engaged pin 67 has a diameter that gradually decreases toward the end.

Referring to FIGS. 1 and 4 to 7, the cover 60 constituted as described above is rotatably supported by the engaging grooves 48 of the side plates 16 via the to-be-supported pins 63. The distance between the pair of opposing inner surfaces 48*a* in the engaging grooves 48 is slightly greater than the distance between the flat surfaces 63*b* of the corresponding to-be-supported pins 63, and the radius of curvature of the arcuate inner surfaces 48*b* in the engaging grooves 48 is slightly greater than the radius of curvature of the arcuate outer peripheral surfaces 63*a* of the corresponding to-be-supported pins 63. The cover 60 is lowered in a manner that the to-be-engaged pin 67 (FIG. 1) is directed downward, the guide ribs 62 are positioned on the downstream side, and the to-be-supported pins 63 are faced above the corresponding engaging grooves 48. Then, pairs of flat surfaces 63*b* of the to-be-supported pins 63 are inserted (not shown) in the arcuate inner surfaces 48*b* passing through the pairs of opposing inner surfaces 48*a* of the corresponding engaging grooves 48.

Next, the cover 60 is turned in the counterclockwise direction by 90 degrees in FIG. 1, whereby pairs of arcuate outer peripheral surfaces 63*a* of the to-be-supported pins 63 are fitted (not shown) onto the arcuate inner surfaces 48*b* of the corresponding engaging grooves 48. Then, the to-be-engaged pin 67 (FIG. 1) of the cover 60 is fitted into the through hole 57 in the support main body portion 51 of the parting member 50 false-mounted on the side plate 18C of the upper coupling plate member 18 and into the engaging groove 46 in the side plate 18C of the upper coupling plate member 18 in a manner that it can be parted therefrom (not shown). Further, the surfaces on the upstream of the end walls 65 of bosses 64 in the cover 60 are overlapped on the surfaces on the downstream of the support main body portion 51 of the parting member 50 (FIG. 1). The through holes 66 of bosses 64, the corresponding through holes 56 in the support main body portion 51 of the parting member 50 and the corresponding internally threaded holes 44 in the side plate 18C of the upper coupling plate member 18 are substantially brought into alignment, and are detachably fastened together by using fastening members such as screws (not shown).

The cover 60 is mounted on the side plate 18C of the upper coupling plate member 18 in a manner that it can be parted while covering the support main body portion 51 of the parting member 50 from the downstream side. The parting member 50 is completely mounted on the side plate 18C of the upper coupling plate member 18 from its false-mounted state. In this state, the guide ribs 62 of the cover 60 have their upstream regions at the lower ends positioned in the corresponding notches 52A in the parting member 50. This state can be so regarded that the parting member 50 is permitting a plurality of guide ribs 62 to be arranged maintaining a distance in the axial direction of the thermally fixing rollers 2. The guide ribs 62 are so arranged as to extend toward the downstream in the direction of conveyance from the region at the downstream end of the paper P in the direction of conveyance on the outer surfaces of the intermediate regions 53A of the parting portion 53 of the parting member 50 and to extend outward of the outer surface of the intermediate regions 53A. According to another embodiment, the guide ribs 62 may be arranged integrally with the parting member 50.

Referring to FIG. 1, when the thermally fixing roller 2 is driven by an electric motor to rotate in the clockwise direction in FIG. 1, the upstream support roller 8 and the down stream support roller 10 are driven together with the belt 4 to rotate in the counterclockwise direction. When the halogen heater H is energized to start generating the heat, the temperature of the thermally fixing roller 2 starts rising. The heat conducted to the thermally fixing roller 2 is further conducted to the belt 4, and to the downstream support roller 8 and the upstream support roller 10 via the belt 4. After the surface temperature of the thermally fixing roller 2 has reached a predetermined temperature from normal temperature, the paper P onto which one surface (upper surface) the toner has been transferred is conveyed from the right toward the left in FIG. 1, and passes through the nipping region N between the thermally fixing roller 2 and the belt 4, whereby the unfixed toner transferred onto the one surface of the paper P is melt-fixed to the one surface of the paper P due to the thermally fixing roller 2.

Figure 3:
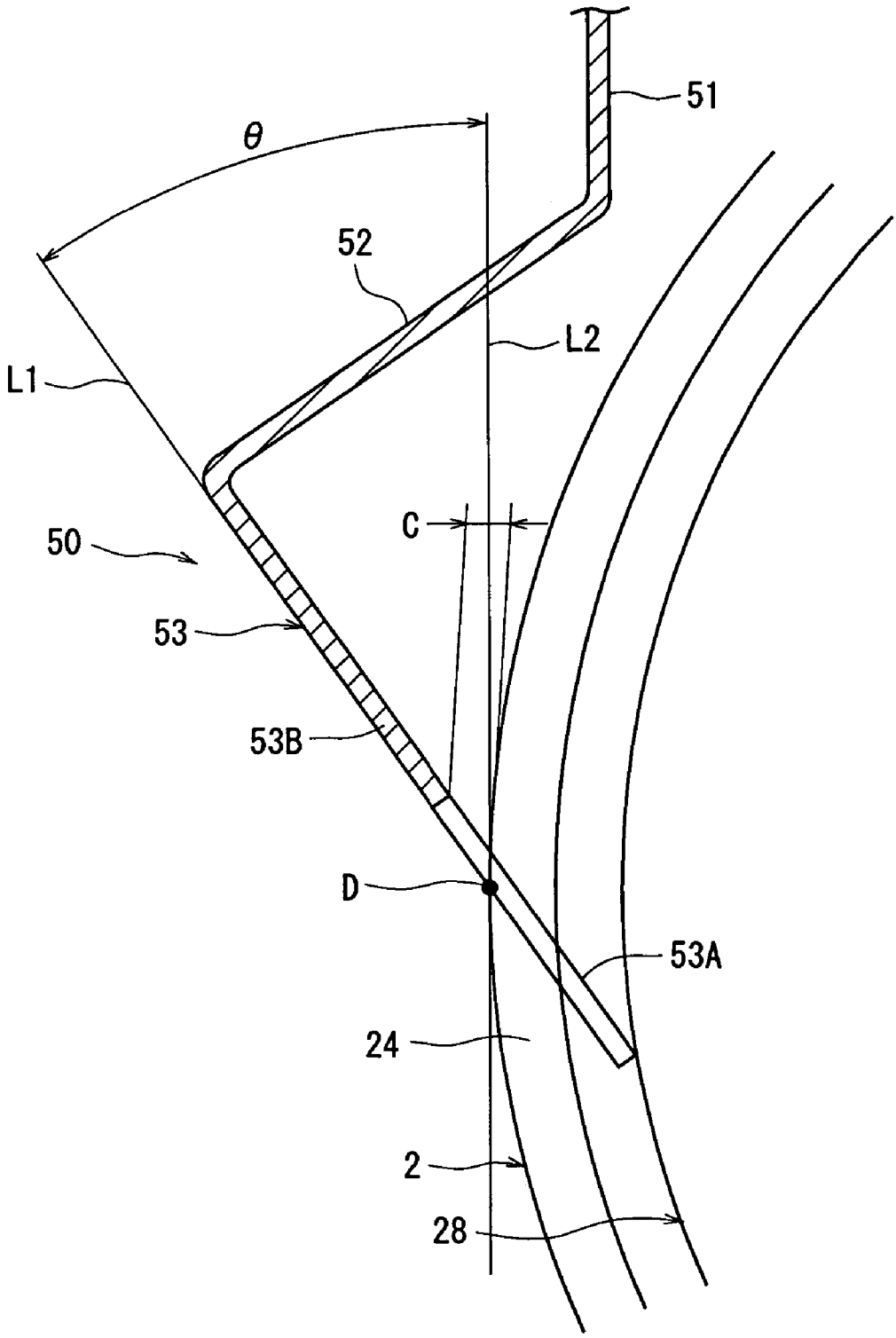
FIG. 3 is a view schematically illustrating the constitution of part of FIG. 2 on an enlarged scale.

The fixing device according to the present invention will be described in further detail with reference to FIGS. 1 to 3. In the fixing device of the present invention, it is important that part of the region of the belt 4 is pushed by the pushing means 6 onto part of the region of the thermally fixing roller 2 in a manner that a pressure distribution is established in the circumferential direction of the nipping region N producing a maximum pressure in an upstream end region of the thermally fixing roller 2 in the direction of rotation in the nipping region N, another maximum pressure in a downstream end region thereof in the direction of rotation in the nipping region N, and a pressure in an intermediate region of the nipping region N between the upstream end region and the downstream end region, which pressure being not higher than the maximum pressure in the upstream end region and not higher than the another maximum pressure in the downstream end region.

According to the above constitution of the present invention, a pre-fixing is effected, first, at a portion of a maximum pressure in the upstream end region in the nipping region N and, thereafter, the paper P passes through the intermediate region having a pressure not higher than the maximum pressure, preventing the paper P on which the toner has been transferred from being excessively heated on one surface thereof. As a result, the water content contained in the paper P is suppressed from being excessively vaporized, and the image is prevented from becoming defective (from producing white spots). Upon setting a maximum pressure in the downstream end region in the nipping region N, the toner is melt-adhered to the paper P to a sufficient degree and a sufficiently favorable fixing property is accomplished.

Figure 14:
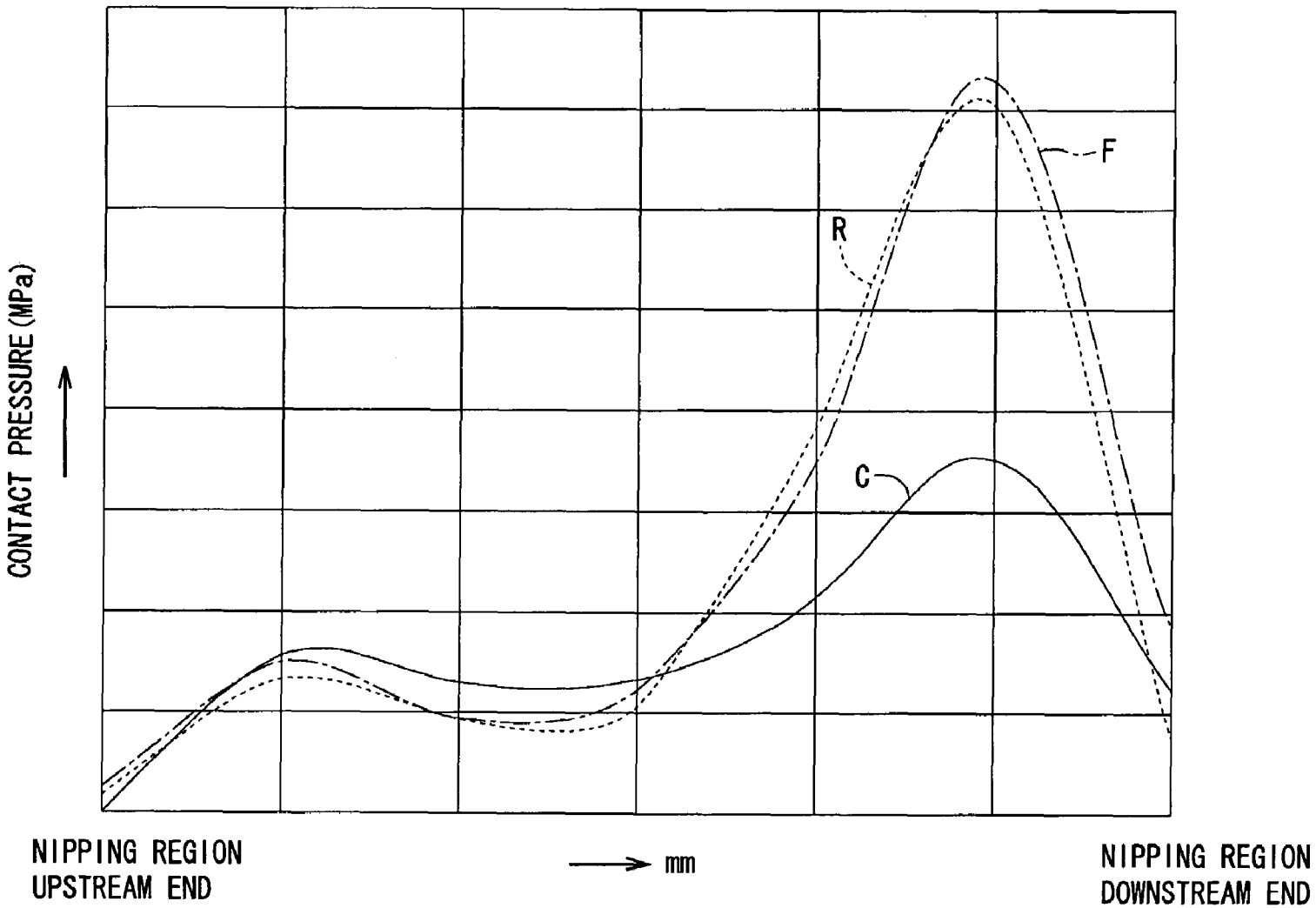
FIG. 14 is a diagram illustrating a model of an embodiment of a pressure distribution in the circumferential direction of the nipping region formed between part of the region of the belt and part of the region of the thermally fixing roller in the fixing device shown in FIG. 1.

In order to make sure the above effect of the present invention, the inventors have conducted an experiment (Experiment 1) by using the above fixing device. In the experiment, a pressure distribution was established in the circumferential direction in the nipping region N as schematically illustrated in FIG. 14. An instrument for measuring the pressure distribution was "a pressure distribution measuring system, PINCHA 4-40 SYSTEM" (manufactured by Nitta Co.), and the pressure distribution was measured by using a sheet sensor of a width of 220 mm. In FIG. 14, a curve F represents a pressure distribution in an end region in the direction of width of the sheet sensor having a width of 220 mm (left side of the paper P in the direction of conveyance as viewed from the upstream side: front side in FIG. 1), a curve R represents a pressure distribution in the other end region in the direction of width of the sheet sensor (right side of the paper P in the direction of conveyance as viewed from the upstream side: back side in FIG. 1), and a curve C represents a pressure distribution in the central region in the direction of width of the sheet sensor. The pressure distribution was measured in a state where the thermally fixing roller 2 remained stationary, as a matter of course. By using an image-forming machine equipped with the above-mentioned fixing device having a pressure distribution in the circumferential direction in the nipping region N, the printing was continued (i.e., fixing was continued) for 100K pieces. After having printed 100K pieces, the occurrence of defective image (white spots) was examined. As a result of experiment, the occurrence of defective image (white spots) was not recognized, and a favorable fixing was confirmed.

Described below are the sizes of the principal constituent parts in the fixing device used for the experiment.

Diameter of the thermally fixing roller 2: 36 mm (cylindrical main body 22 made of aluminum)

Thickness of the silicone rubber which is an elastic material covering the thermally fixing roller 2: 1.0 mm Diameter of the upstream support roller 8: 16 mm (cylindrical main body made of SUS)

Diameter of the downstream support roller 10: 16 mm (cylindrical main body made of SUS)

Diameter of the belt 4: 30 mm

Material of the belt 4: polyimide (thickness; 50 μm)

Rotational speed of the thermally fixing roller 2: 83 rpm

Length of the nipping region N in the circumferential direction: 12 mm

In the fixing device of the present invention, it is desired that the thermally fixing roller 2 includes a cylindrical main body 22 made of a metal and an elastic layer 24 arranged on the outer peripheral surface of the cylindrical main body 22, that the pushing portion (downstream support roller 10 in this embodiment) in the downstream end region of the pushing means 12 is constituted by a member (cylindrical main body 30 made of a metal in this embodiment) harder than the elastic layer 24, and that the maximum pressure in the upstream end region is smaller than the maximum pressure in the downstream end region in the nipping region N. Owing to this constitution, a dent is formed by the pushing force in the outer peripheral surface of the elastic layer 24 on the thermally fixing roller 2 in the upstream end region. Therefore, the paper P is directed so as to be parted outward in the radial direction from the outer peripheral surface of the elastic layer 24 of the thermally fixing roller 2. As a result, the paper P is more favorably parted from the outer peripheral surface of the elastic layer 24 of the thermally fixing roller 2.

In the fixing device of the present invention, it is desired that when the diameter of the thermally fixing roller 2 is denoted by D (mm), the length of the nipping region N in the circumferential direction by L (mm), the rotational speed of the thermally fixing roller 2 by R (rpm), and when the nipping time S (seconds) until when the upstream end of part of the region of the belt 4 separates away from the thermally fixing roller 2 after having moved accompanying the turn of the thermally fixing roller 2 is denoted by $60\ L/R\pi D$, the nipping time S (seconds) is defined to satisfy the following formula, $$0.04(\text{seconds}) \leqq S(\text{seconds}) \leqq 0.08(\text{seconds}).$$

The present inventors have conducted an experiment (Experiment 2) by giving attention to the relationships among the nipping time S (seconds), fixing property, parting of the paper P and curling of the paper. The nipping time S can be obtained by setting the length L of the nipping region N in the circumferential direction, by setting the diameter D of the thermally fixing roller 2 and by setting the rotational speed R of the thermally fixing roller 2. Experiment 2 was conducted under the same conditions as in Experiment 1 by determining in advance the length L of the nipping region N in the circumferential direction and the diameter D of the thermally fixing roller 2, and by varying the rotational speed R of the thermally fixing roller 2. The results were as shown in FIG. 15. The fixing property was evaluated by rubbing and folding the image-forming region of the paper P to make sure if the image has peeled away on the flat portion and on the folded portion. A mark ○ in the evaluation of fixing property represents that the image has not peeled away, and a mark X represents that the image has peeled away. The parting was evaluated by making sure whether the jamming (jamming of the paper P) has occurred or whether the paper was undesirably fed (the paper P was fed with its corner being folded, with its end being damaged, etc.) though the jamming did not occur. A mark ○ in the evaluation of parting represents that there occurred no jamming, a mark X represents that the jamming has occurred and a mark Δ represents that the paper was undesirably fed. The curling was evaluated by measuring a maximum height of the paper P from the surface of a flat plate in a state where the paper P just after discharged was placed on the flat plate. A mark ○ in the evaluation of curling represents that a maximum height was smaller than a reference height, a mark X represents that the maximum height has exceeded the reference height, and a mark Δ represents that the maximum height was equal to the reference height. According to the experimental results shown in FIG. 15, it was confirmed that upon setting the nipping time S (seconds) to lie in a range of 0.04 (seconds) to 0.08 (seconds), the problems were virtually cleared concerning the fixing, parting of the paper P and curling of the paper P.

The fixing device according to the present invention is provided with the parting member 50 for parting the paper P conveyed through the nipping region N from the outer peripheral surface of the thermally fixing roller 2 (see FIGS. 1 and 2). The parting member 50 is made of a piece of metal plate extending in the axial direction of the thermally fixing roller 2, and has a parting portion 53 (53B) linearly extending toward the outer peripheral surface of the thermally fixing roller 2 from the outer side in the radial direction of the thermally fixing roller 2 and toward the upstream from the downstream in the direction of rotation when the thermally fixing roller 2 is viewed in the axial direction. The tip of the parting portion 53 (53B) is positioned maintaining a gap C (see FIG. 3) of 0.5 mm to 2.0 mm with respect to the outer peripheral surface on the paper-passing region F (see FIG. 8) of the thermally fixing roller 2. As will be easily understood from FIG. 3, the gap C stands for the smallest gap in the gaps between the tip of the parting portion 53 (53B) and the thermally fixing roller 2.

The present inventors have conducted an experiment (Experiment 3) by giving attention to the relationship among the gap C between the parting member 50 and the outer peripheral surface of the thermally fixing roller 2, parting of the paper P, scars on the outer peripheral surface of the thermally fixing roller 2 and contamination on the surface of the paper. In the Experiment 3, by using the image-forming machine equipped with the fixing device same as the one used in Experiment 1, the printing was continued (i.e., fixing was continued) for 100K pieces. After having printed 100K pieces, parting of the paper P, scars on the outer peripheral surface of the thermally fixing roller 2 and contamination of the paper surface were evaluated. The results were as shown in FIG. 16. Evaluation of the parting was the same as that of Experiment 1 and is not described here. Scars on the outer peripheral surface of the thermally fixing roller 2 were evaluated by making sure whether the patterns of scars have appeared on the image. In the evaluation of scars on the outer peripheral surface of the thermally fixing roller 2, a mark ○ represents that the patterns of scars did not appear on the image, and a mark X represents that the patterns of scars have appeared on the image. Contamination on the paper surface was evaluated by making sure if the toner which is not that of the image has been adhered to the paper P. In the evaluation of contamination on the paper surface, a mark ○ represents that the toner which is not that of the image has been adhered on the paper P, and a mark X represents that the toner which is not that of the image has not been adhered on the paper P. According to the results of experiment shown in FIG. 16, it was confirmed that upon setting the gap C to be from 0.5 mm to 2.0 mm, favorable parting of the paper P was maintained, no scar was formed in the outer peripheral surface of the thermally fixing roller 2, and the paper surface was not contaminated. In Experiment 3, when the gap C was set to be not larger than 0.3 mm, the outer peripheral surface of the thermally fixing roller 2 was brought into contact with the tip of the parting portion 53B due to the thermal expansion of the thermally fixing roller 2, developing such inconveniences that the outer peripheral surface of the thermally fixing roller 2 was scarred and the paper surface was contaminated by the adhesion of the toner. When the above gap C was set to be 2.5 mm, it was confirmed that a problem has occurred in parting the paper P such as jamming.

In the fixing device of the present invention, it is desired that when the thermally fixing roller 2 is viewed in the axial direction, the angle θ of inclination (see FIGS. 2 and 3) of the outer surface of the parting portion 53 (53B)is not larger than 40 degrees, which is defined by a straight line L1 in agreement with the outer surface of the parting portion 53 (53B) and by a tangential line L2 of the outer peripheral surface of the thermally fixing roller 2 that passes through a point D where the straight line L1 in agreement with the outer surface of the parting portion 53 (53B) of the parting member 50 intersects the outer peripheral surface on the paper-passing region F (see FIG. 8) of the thermally fixing roller.

The present inventors have conducted an experiment (Experiment 4) by giving attention to the relationship among the angle θ of inclination of the parting portion 53 (53B) of the parting member 50, parting of the paper P, and disturbance of the image. In the Experiment 4, by using the image-forming machine equipped with the fixing device same as the one used in Experiment 3, the printing was continued (i.e., fixing was continued) for 100K pieces. After having printed 100K pieces, parting of the paper P and disturbance of the image were evaluated. The results of experiment were as shown in FIG. 17. Evaluation of the parting was the same as that of Experiment 1 and is not described here. Disturbance of the image was evaluated by making sure whether the rubbing scars were formed when the one surface of the paper P on which the toner has been fixed was rubbed by the outer surface of the parting portion 53 (53B). In the evaluation of disturbance of the image, a mark ○ represents that no rubbing scar was formed, and a mark X represents the rubbing scars were formed. According to the experimental results shown in FIG. 17, it was confirmed that inconvenience occurred concerning parting of the paper P and disturbance of the image when the angle θ of inclination has exceeded 45 degrees. As a result, it was confirmed that if the angle θ of inclination in the parting portion 53 (53B) of the parting member 50 was set to be not larger than 40 degrees, the paper P could be favorably parted without causing disturbance on the image.

In the fixing device of the present invention, it is desired that when the thermally fixing roller 2 is viewed in the axial direction and when a time from when a point on the outer peripheral surface of the thermally fixing roller 2 has separated away from the nipping region N until when it arrives at a point D where a straight line L1 in agreement with the outer surface of the parting portion 53 (53B) of the parting member 50 intersects the outer peripheral surface on the paper-passing region F of the thermally fixing roller 2, is regarded to be a parting time T (seconds), the parting time T (seconds) is defined to be within 60% to 100% of the nipping time S (seconds).

The present inventors have conducted an experiment (Experiment 5) by giving attention to a relationship between the nipping time S (seconds) and the parting time T (seconds) and a relationship between parting of the paper P and occurrence of curling of the paper P. In the Experiment 5, by using the image-forming machine equipped with the fixing device same as the one used in Experiment 3, the printing was continued (i.e., fixing was continued) for 100K pieces. After having printed 100K pieces, parting of the paper P and curling of the paper P were evaluated. The nipping time S was fixed to 0.077 (seconds) The results were as shown in FIG. 18. Parting and curling were evaluated in the same manner as in Experiment 1 and are not described here again. According to the experimental results shown in FIG. 18, parting becomes poor when the ratio of the parting time T (seconds) becomes low (smaller than 50%) relative to the nipping time S (seconds). When the ratio of the parting time T (seconds) becomes high (not smaller than 10%) relative to the nipping time S (seconds), curling occurs being affected by the curvature of the thermally fixing roller 2. As a result, if the parting time T (seconds) was set to be 60% to 100% of the nipping time S (seconds), it was confirmed that the paper P could be favorably parted without developing curling.

In the fixing device of the present invention, positioning means having a circular outer peripheral surface in concentric with the thermally fixing roller 2 is arranged on each of the paper non-passing regions (regions on both outer sides of the paper-passing region F in the axial direction) which are both end regions of the thermally fixing roller 2 in the axial direction. It is desired that the tips at both ends of the parting member 50 in the axial direction come in contact with the outer peripheral surface of the corresponding positioning means to set the gap C. In this embodiment as shown in FIGS. 2, 3 and 7 to 9, the positioning means is constituted by bearings 28 that support the thermally fixing roller 2. In a state where the parting member 50 is completely mounted on the side plate 18C of the upper coupling plate member 18 together with the cover 60, as described earlier, the tips of both end regions 53A of the parting portion 53 of the parting member 50 are brought into contact with the outer peripheral surfaces of the corresponding bearings 28 to set a gap C between the intermediate region 53B of the parting portion 53 and the outer peripheral surface of the thermally fixing roller 2, making it possible to easily and reliably improve the precision of the gap C.

The positioning means can be easily constituted by positioning portions arranged integrally on the thermally fixing roller 2. As shown, for example, in FIG. 10, both ends of the cylindrical main body 22 of the thermally fixing roller 2 are extended outward in the axial direction, so that outer peripheral surfaces 22*a* of the cylindrical main body 22 without the elastic layer 24 are exposed at both ends of the thermally fixing roller 2. The outer peripheral surfaces 22*a* of the cylindrical main body 22 can be easily utilized as the positioning portions.

In the fixing device of the present invention, a plurality of guide ribs 62 (see FIGS. 1 and 7) are arranged on the parting member 50 maintaining a distance in the axial direction. The guide ribs 62 are so arranged as to extend toward the downstream in the direction of conveyance from the downstream end region of the paper P in the direction of conveyance on the outer surface of the parting portion 53 (53B) and to extend outward of the outer surface of the parting portion 53 (53B). The paper P is, first, guided by the outer surface of the parting portion 53 (53B) and is parted from the thermally fixing roller 2 and is, then, guided toward the downstream by the lower guide surfaces 62*a* of the guide ribs 62, featuring improved parting performance.

Figure 11:
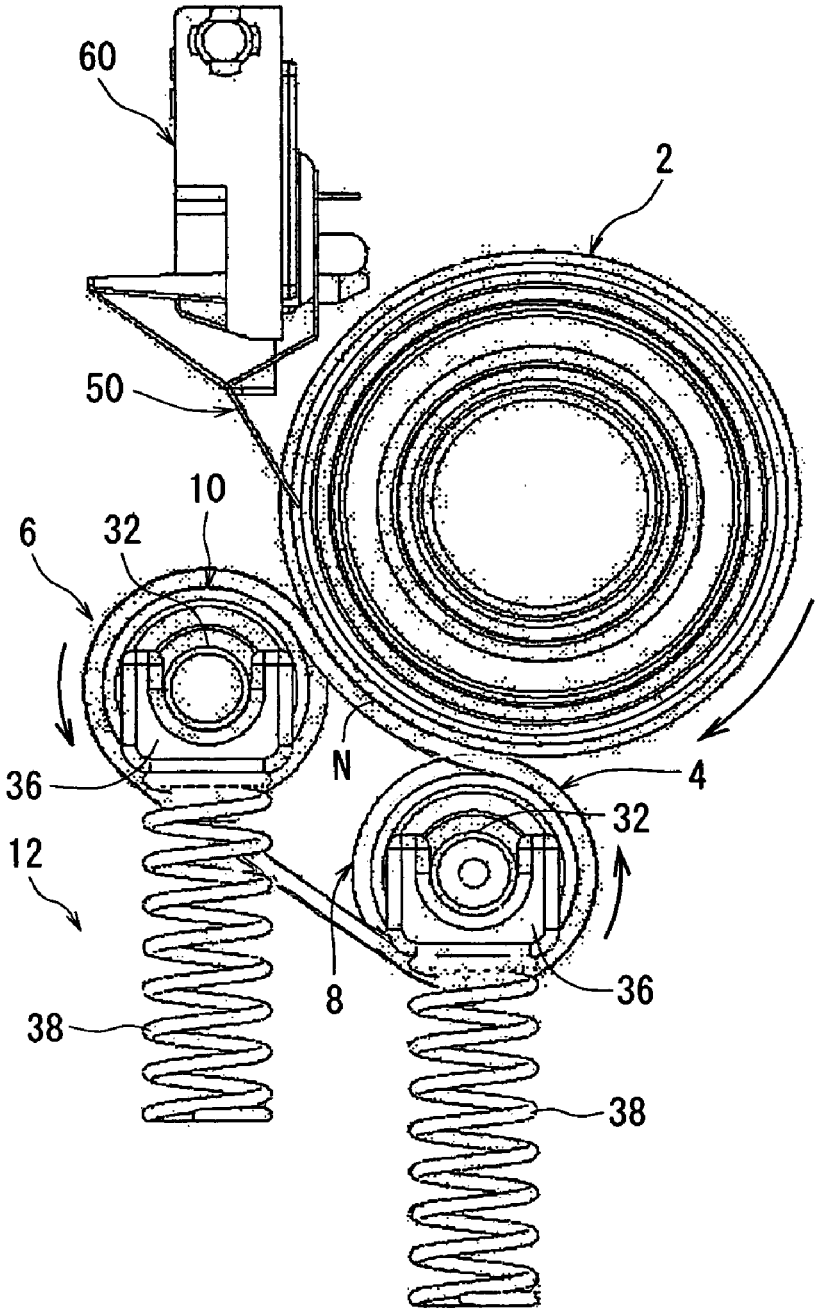
FIG. 11 is a view schematically illustrating the constitution of a major portion of the fixing device constituted according to another embodiment of the present invention, and is a schematic view of constitution as viewed in the axial direction of the rollers.

FIG. 11 illustrates another embodiment of the fixing device according to the present invention. The fixing device shown in FIG. 11 is substantially the same as the fixing device shown in FIG. 1 except that the upstream support roller 8 and the downstream support roller 10 are pushed by the compression coil springs 38 in a direction different from the direction in the fixing device shown in FIG. 1. In the fixing device shown in FIG. 11, when the thermally fixing roller 2 is viewed in the axial direction, the pushing direction of the one compression coil spring 38 (right side in FIG. 11) is the one heading to the thermally fixing roller 2 along an imaginary line that extends being inclined relative to the imaginary line that passes through the axis of the thermally fixing roller 2. Further, when the thermally fixing roller 2 is viewed in the axial direction, the pushing direction of the other compression coil spring 38 (left side in FIG. 11) is the tangential direction of the thermally fixing roller 2 along an imaginary line in parallel with the imaginary line which is in agreement with the pushing direction of the compression coil spring 38. The pressure distribution in the circumferential direction of the nipping region N shown in FIG. 14 can be obtained even by using the pushing mechanism 12 including the above-mentioned constitution.

Figure 12:
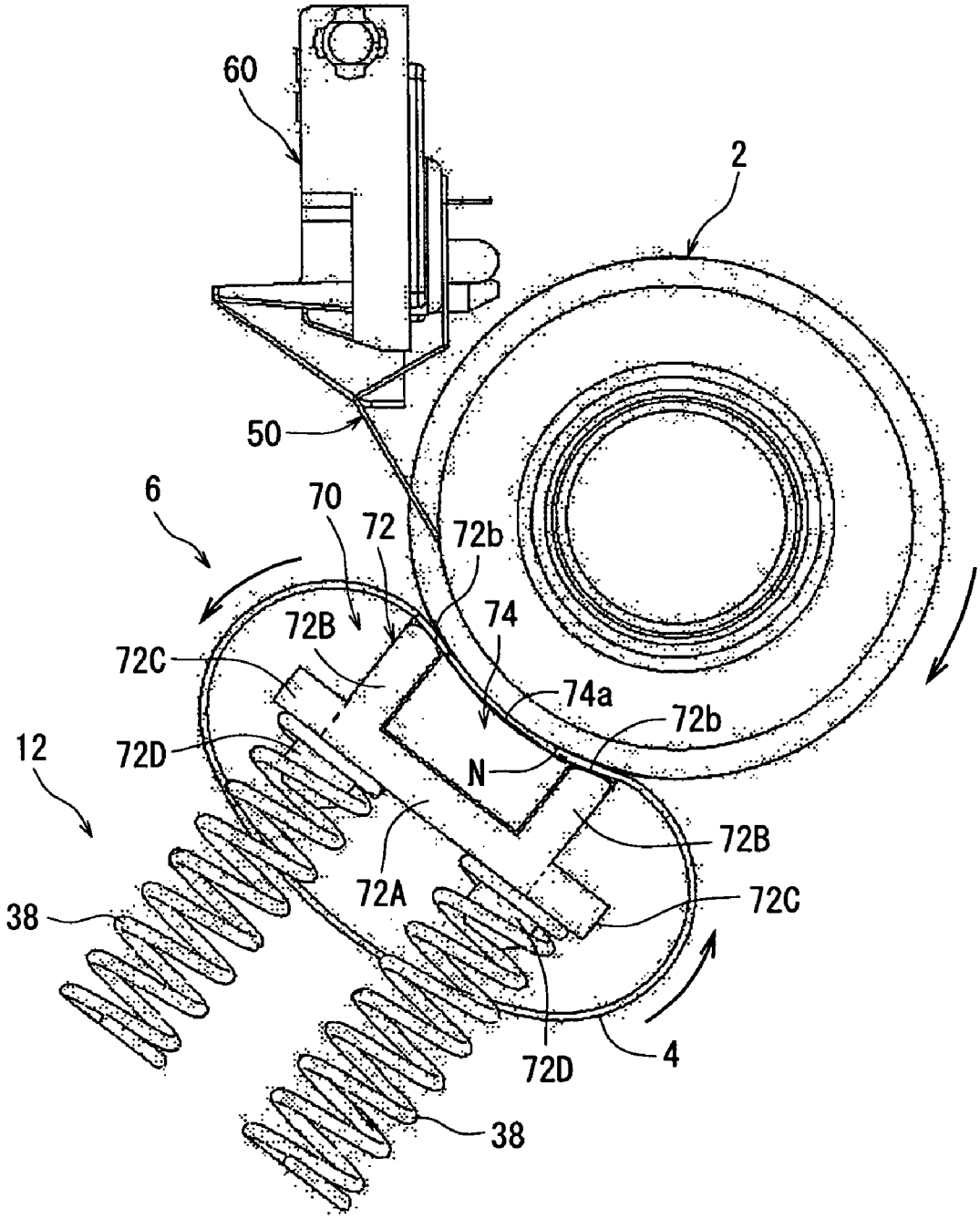
FIG. 12 is a view schematically illustrating the constitution of a major portion of the fixing device according to a further embodiment of the present invention, and is a schematic view of constitution as viewed in the axial direction of the rollers.
Figure 13:
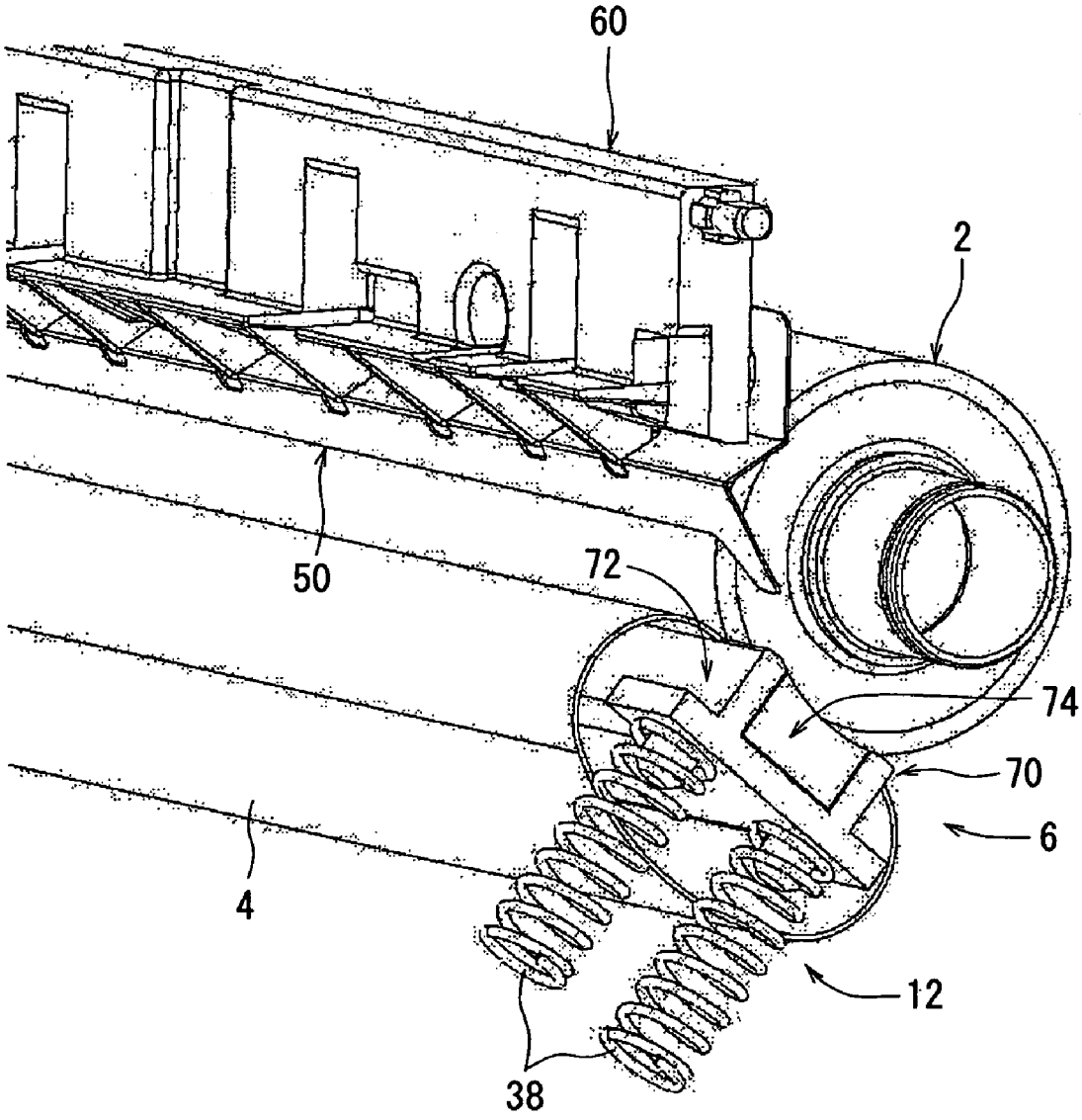
FIG. 13 is a schematic perspective view of when the fixing device shown in FIG. 12 is viewed from a lower direction.

FIGS. 12 and 13 illustrate another embodiment of the fixing device of the present invention. In the fixing device shown in FIG. 1, the pushing member constituting the pushing means 6 which pushes the belt 4 toward the thermally fixing roller 2 from the side of the inner peripheral surface of the belt 4, includes the upstream support roller 8 and the downstream support roller 10. In the fixing device shown in FIGS. 12 and 13, on the other hand, the pushing member is constituted by one pushing unit 70 which includes a main member 72 and an auxiliary member 74.

The main member 72 includes a rectangular base plate 72A which extends straight and slenderly maintaining a predetermined width and thickness, and a pair of side walls 72B erected from both sides of the base plate 72A in the direction of width. The side walls 72B have nearly the same height from the base plate 72A. At both ends of the base plate 72A in the lengthwise direction, there are formed flanges 72C integrally therewith so as to extend toward both sides in the direction of width. On the lower surface at both ends of the base plate 72A in the lengthwise direction, there are formed a pair of protuberances 72D so as to protrude downward beyond the bottom surface maintaining a distance in the direction of width. The protuberances 72D are provided for positioning the upper ends of the compression coil springs 38. When the main member 72 is viewed in the lengthwise direction, the upper end surfaces 72*b* of the side walls 72B are forming protruded arcuate surfaces or curved surfaces. The main member 72 has a length greater than the width of the belt 4. The main member 72 constituted as described above can be integrally formed by using a suitable material. In this embodiment, however, the main member 72 is integrally formed by using aluminum.

The auxiliary member 74 has a slender and nearly rectangular parallelepiped shape, and is of a size which substantially fills a channel-like space defined by the base plate 72A and by the side walls 72B of the main member 72 from one end through up to the other end of the main member 72 in the lengthwise direction. The upper end surface 74a of the auxiliary member 74 is a recessed arcuate surface or a curved surface. The thus constituted auxiliary member 74 can be integrally formed by using a suitable material. In this embodiment, however, the auxiliary member 74 is integrally formed by using a silicone rubber. The auxiliary member 74 is integrally fixed into the space of the main member 72 by suitable fixing means such as press-insertion, adhesion or baking.

In a state where the pushing unit 70 is inserted in the endless belt 4, the pushing unit 70 is so positioned that both ends thereof in the lengthwise direction including flanges 72C and protuberances 72D protrude outward from both sides of the belt 4 in the direction of width. Due to the compression coil springs 38, the pushing unit 70 pushes the belt 4 toward the thermally fixing roller 2 from the side of the inner peripheral surface of the belt 4. The upper end surfaces 72*b* of side walls 72A of the main member 72 and the upper end surface 74*a* of the auxiliary member 74 in the pushing unit 70 are pushed onto the outer peripheral surface of the thermally fixing roller 2 via the belt 4 to form the nipping region N. The belt 4 is driven by the thermally fixing roller 2 that is driven to rotate. To limit the movement of the belt 4 in the direction of width, it is desired to form annular flanges (not shown) at both ends of the pushing unit 70 in the lengthwise direction and on the inside of the flanges 72C. The pressure distribution in the nipping region N in the circumferential direction shown in FIG. 14 is obtained even by the pushing mechanism 12 including the above constitution. The constitution of the fixing device shown in FIGS. 12 and 13 in other respects is substantially the same as that of the fixing device shown in FIG. 1, and is not described here again.

As described earlier, FIG. 14 is a diagram of a pressure distribution in the nipping region N producing a maximum pressure in an upstream end region of the thermally fixing roller in the direction of rotation in the nipping region N, another maximum pressure in a downstream end region thereof in the direction of rotation in the nipping region N, and a pressure in an intermediate region of the nipping region N between the upstream end region and the downstream end region, which pressure being not higher than the maximum pressure in the upstream end region and not higher than the another maximum pressure in the downstream end region. The pressure distribution is the result of experiment and it needs not be pointed out that various forms may exist without departing from the scope of the present invention. Constitution of the pushing means 6 for establishing the above pressure distribution, too, is not limited to the diagramed embodiments only, but may be realized in any other embodiment.

The fixing device according to the present invention is so constituted that the downstream support roller 10 as well as the upstream support roller 8 are brought into pressed contact with the thermally fixing roller 2 via the belt 4. There, however, is another embodiment in which the downstream support roller 10 only is brought into pressed contact with the thermally fixing roller 2 via the belt 4. This embodiment, too, works to accomplish the above-mentioned effect of the invention.

What we claim is:

1. A fixing device comprising a thermally fixing roller, an endless belt, and pushing means which pushes said belt toward the thermally fixing roller from the side of the inner peripheral surface of said belt such that part of the region in the circumferential direction on the outer peripheral surface of said belt is pushed onto part of the region in the circumferential direction on the outer peripheral surface of the thermally fixing roller, wherein a nipping region is formed between said part of the region of said belt and said part of the region of the thermally fixing roller that come in contact with each other, and said belt is driven when the thermally fixing roller is driven to rotate, wherein said part of the region of said belt is pushed by pushing means onto said part of the region of the thermally fixing roller in a manner that a pressure distribution is established in the circumferential direction of said nipping region, said pressure distribution producing a maximum pressure in an upstream end region of the thermally fixing roller in the direction of rotation in said nipping region, another maximum pressure in a downstream end region thereof in the direction of rotation in said nipping region, and a pressure in an intermediate region of said nipping region between said upstream end region and said downstream end region, which pressure is not higher than said maximum pressure in said upstream end region and not higher than said another maximum pressure in said downstream end region, and wherein said maximum pressure in said upstream end region in said nipping region is smaller than said another maximum pressure in said downstream end region.

2. A fixing device according to claim 1, wherein said thermally fixing roller includes a cylindrical main body made of a metal and an elastic layer arranged on the outer peripheral surface of the cylindrical main body, a pushing portion in said downstream end region of the pushing means is constituted by a member harder than said elastic layer.

3. A fixing device according to claim 1, wherein when the diameter of the thermally fixing roller is denoted by D (mm), the length of said nipping region in the circumferential direction by L (mm), the rotational speed of the thermally fixing roller by R (rpm), and when the nipping time S (seconds) until when the upstream end of said part of the region of said belt separates away from the thermally fixing roller after having moved accompanying the turn of the thermally fixing roller is denoted by 60 L/RπD, said nipping time S (seconds) is defined to satisfy the following formula, $$0.04(\text{seconds}) \leqq S(\text{seconds}) \leqq 0.08(\text{seconds}).$$

4. A fixing device according to claim 1, wherein provision is made of a parting member for parting the paper conveyed through said nipping region from the outer peripheral surface of the thermally fixing roller, the parting member being made of a piece of metal plate extending in the axial direction of the thermally fixing roller, and having a parting portion linearly extending toward the outer peripheral surface of the thermally fixing roller from the outer side in the radial direction of the thermally fixing roller and toward the upstream from the downstream in the direction of rotation when the thermally fixing roller is viewed in the axial direction, and the tip of the parting portion is positioned maintaining a gap of 0.5 mm to 2.0 mm with respect to the outer peripheral surface on the paper-passing region of the thermally fixing roller.

5. A fixing device according to claim 4, wherein, when the thermally fixing roller is viewed in the axial direction, the angle of inclination of the outer surface of the parting portion is not larger than 40 degrees, which is defined by a straight line in agreement with the outer surface of the parting portion and by a tangential line of the outer peripheral surface of the thermally fixing roller that passes through a point where the straight line in agreement with the outer surface of the parting portion intersects the outer peripheral surface on the paper-passing region of the thermally fixing roller.

6. A fixing device comprising a thermally fixing roller, an endless belt, and pushing means which pushes said belt toward the thermally fixing roller from the side of the inner peripheral surface of said belt such that part of the region in the circumferential direction on the outer peripheral surface of said belt is pushed onto part of the region in the circumferential direction on the outer peripheral surface of the thermally fixing roller, wherein a nipping region is formed between said part of the region of said belt and said part of the region of the thermally fixing roller that come in contact with each other, and said belt is driven when the thermally fixing roller is driven to rotate, wherein said part of the region of said belt is pushed by pushing means onto said part of the region of the thermally fixing roller in a manner that a pressure distribution is established in the circumferential direction of said nipping region, said pressure distribution producing a maximum pressure in an upstream end region of the thermally fixing roller in the direction of rotation in said nipping region, another maximum pressure in a downstream end region thereof in the direction of rotation in said nipping region, and a pressure in an intermediate region of said nipping region between said upstream end region and said downstream end region, which pressure is not higher than said maximum pressure in said upstream end region and not higher than said another maximum pressure in said downstream end region, wherein provision is made of a parting member for parting the paper conveyed through said nipping region from the outer peripheral surface of the thermally fixing roller, the parting member being made of a piece of metal plate extending in the axial direction of the thermally fixing roller, and having a parting portion linearly extending toward the outer peripheral surface of the thermally fixing roller from the outer side in the radial direction of the thermally fixing roller and toward the upstream from the downstream in the direction of rotation when the thermally fixing roller is viewed in the axial direction, and the tip of the parting portion is positioned maintaining a gap of 0.5 mm to 2.0 mm with respect to the outer peripheral surface on the paper-passing region of the thermally fixing roller, and wherein, when the thermally fixing roller is viewed in the axial direction and when a time from when a point on the outer peripheral surface of the thermally fixing roller has separated away from said nipping region until when it arrives at a point where a straight line in agreement with the outer surface of the parting portion of the parting member intersects the outer peripheral surface on the paper-passing region of the thermally fixing roller, is regarded to be a parting time T (seconds), the parting time T (seconds) is defined to be within 60% to 100% of the nipping time S (seconds).

7. A fixing device according to claim 4, wherein positioning means having a circular outer peripheral surface in concentric with the thermally fixing roller is arranged on each of the paper non-passing regions which are both end regions of the thermally fixing roller in the axial direction, and tips at both ends of the parting member in the axial direction come in contact with the outer peripheral surface of the corresponding positioning means to set said gap.

8. A fixing device according to claim 7, wherein each of said positioning means comprises a positioning portion arranged integrally on the thermally fixing roller and a bearing member for rotatably supporting the thermally fixing roller.

9. A fixing device according to claim 4, wherein a plurality of guide ribs are arranged on the parting member maintaining a distance in the axial direction, the guide ribs being so arranged as to extend toward the downstream in the direction of conveyance from the downstream end region of the paper in the direction of conveyance on the outer surface of the parting portion and to extend outward of the outer surface of the parting portion.

* * * * *